US006283662B1

(12) United States Patent
Inoue et al.

(10) Patent No.: US 6,283,662 B1
(45) Date of Patent: Sep. 4, 2001

(54) INK APPLICATOR, INK BACKFLOW PREVENTION MECHANISM OF INK APPLICATOR, AND A PEN TIP

(75) Inventors: Shigeyasu Inoue, Nara; Tatsuya Ozu, Osaka; Yasunori Nakatani, Hyogo, all of (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 09/355,661

(22) PCT Filed: Dec. 2, 1998

(86) PCT No.: PCT/JP98/05456

§ 371 Date: Oct. 21, 1999

§ 102(e) Date: Oct. 21, 1999

(87) PCT Pub. No.: WO99/28139

PCT Pub. Date: Jun. 10, 1999

(51) Int. Cl.[7] ..... B43K 7/10
(52) U.S. Cl. ..... 401/216; 401/219
(58) Field of Search ..... 401/141, 142, 401/205, 200, 209, 213, 214, 216, 219, 220, 232

(56) References Cited

U.S. PATENT DOCUMENTS

| | | | | |
|---|---|---|---|---|
| 3,003,184 | * | 10/1961 | Rosenthal | 401/206 |
| 3,792,932 | * | 2/1974 | Henriksen | 401/148 |
| 5,348,411 | * | 9/1994 | Ozu et al. | 401/219 |
| 5,474,603 | * | 12/1995 | Miyashita et al. | 106/25 R |
| 5,655,847 | * | 8/1997 | Kobayashi et al. | 401/219 |
| 5,678,942 | * | 10/1997 | Kobayashi et al. | 401/219 |
| 5,709,493 | * | 1/1998 | Kobayashi et al. | 401/219 |
| 5,711,626 | * | 1/1998 | Kobayashi et al. | 401/219 |
| 5,762,434 | * | 6/1998 | Nagashima et al. | 401/209 |
| 5,868,512 | * | 2/1999 | Fukushima | 401/219 |

FOREIGN PATENT DOCUMENTS

| | | |
|---|---|---|
| 2121984 | 10/1990 | (JP) . |
| 9315080 | 12/1997 | (JP) . |
| 10236063 | 9/1998 | (JP) . |
| 10236064 | 9/1998 | (JP) . |

OTHER PUBLICATIONS

Page from Jindal Stainless web site, Oct. 2000.*
Pages from Able Barmilling & Manufacturing web site, Oct. 2000.*

* cited by examiner

*Primary Examiner*—Gregory L. Huson
*Assistant Examiner*—Peter deVore
(74) *Attorney, Agent, or Firm*—Wood, Phillips, VanSanten, Clark & Mortimer

(57) ABSTRACT

An applicator that makes it unlikely for an ink, particularly water-based or alcohol solvent ink, to become blurred and assures smooth writing, including an ink reservoir accommodating an ink, a penpoint tip for ink application, and a valve mechanism, wherein the valve mechanism has an axially movable valve body, a valve seat situated on the side of the ink reservoir with respect to the valve body, and a valve support situated on the side of the tip with respect to the valve body; the valve support can anchor the valve body and has an interstice between it and the valve body through which the ink passes; when the tip is disposed upward, the valve body contacts the valve seat to prevent backflow of ink from the tip toward the ink reservoir; and when the tip is disposed downward, the valve body contacts the valve support, allowing the ink to flow through the interstice toward the tip; characterized in that a portion of the valve body that contacts the valve support is formed spherical, and the projected area of the interstice not covered by the valve body produced by projecting the valve body and the interstice onto a plane perpendicular to the axis is 0.035 $mm^2$ or more.

29 Claims, 14 Drawing Sheets

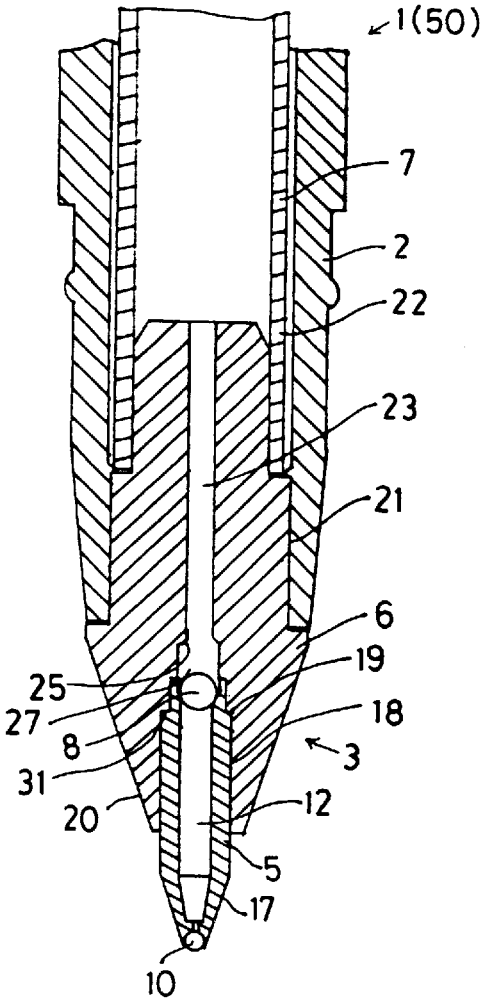
FIG. 1
FIG. 2B
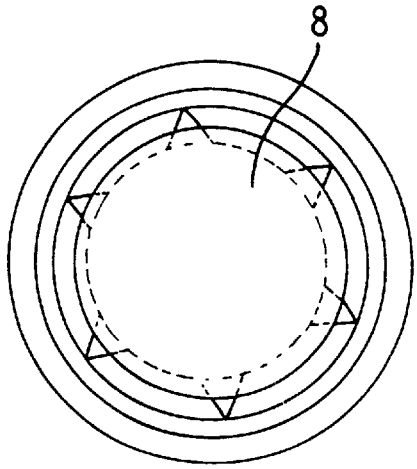
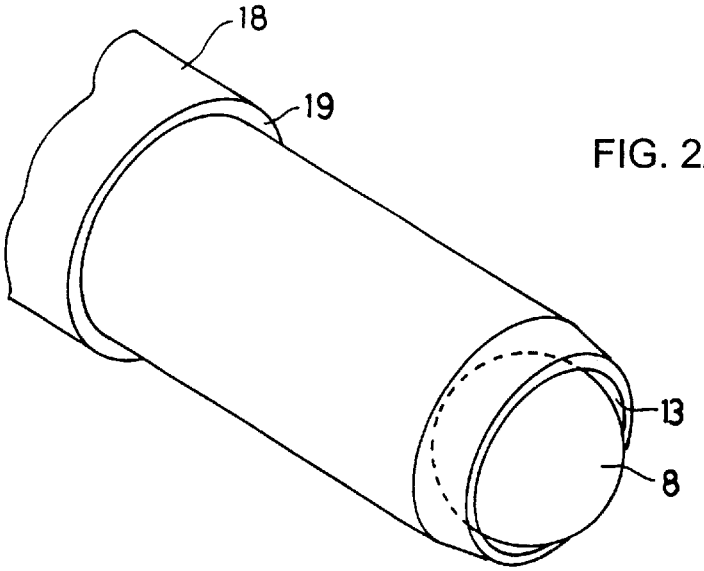
FIG. 2A

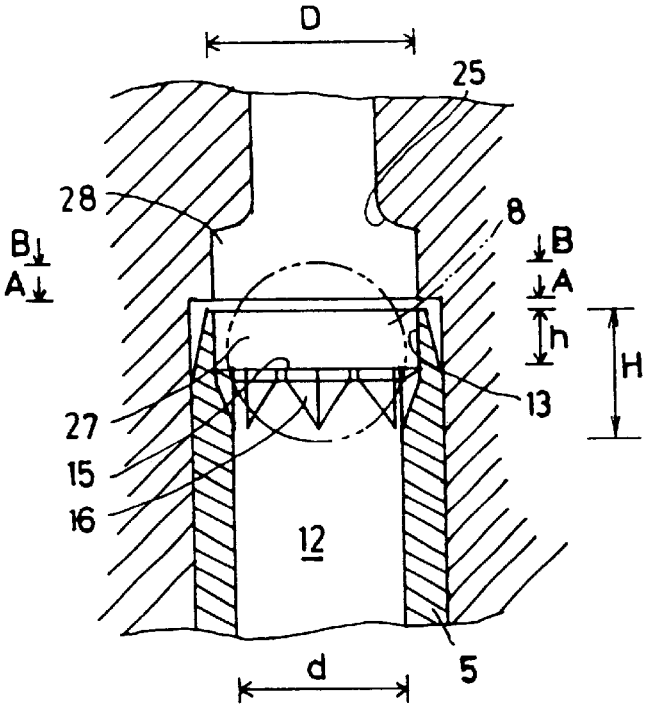
FIG. 4
FIG. 5
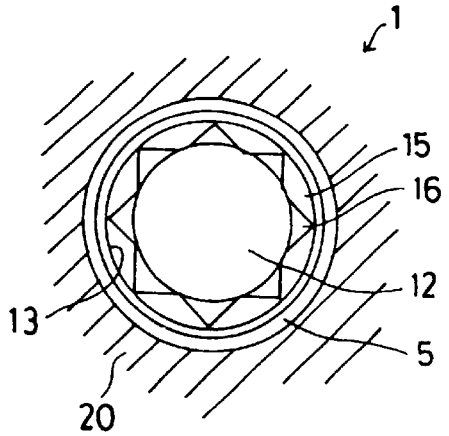
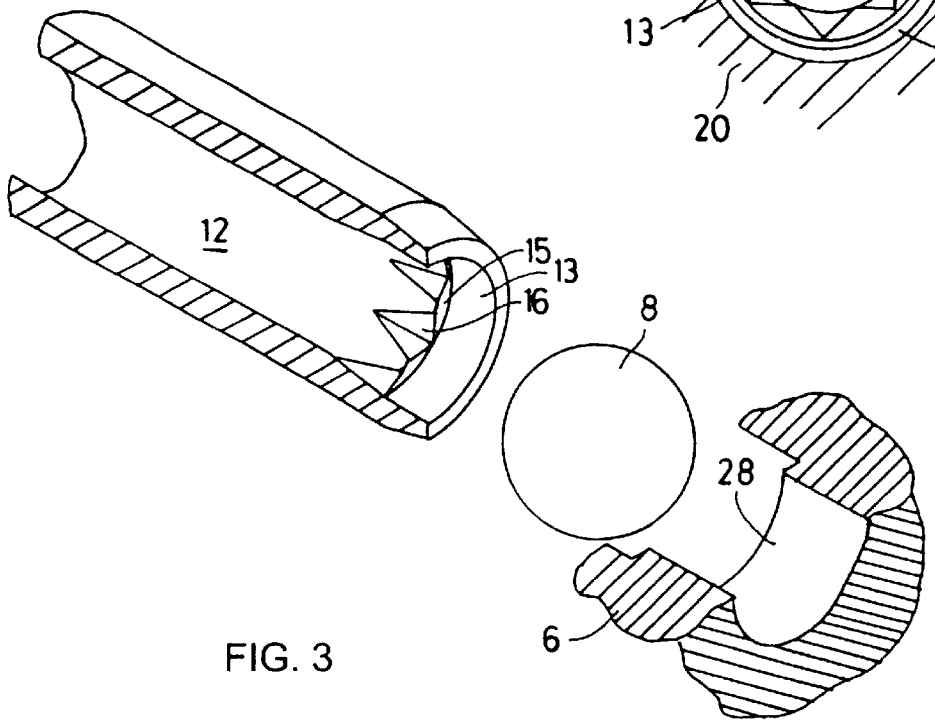
FIG. 3

FIG. 9A
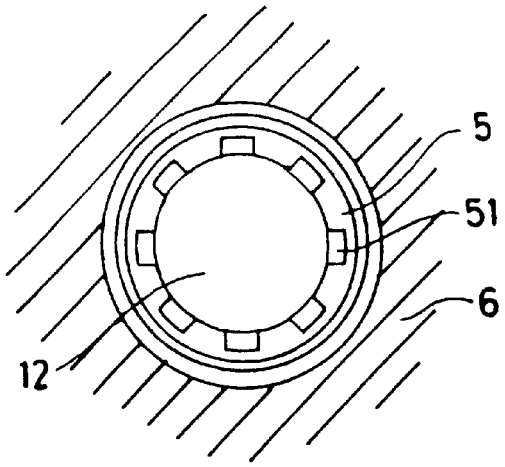
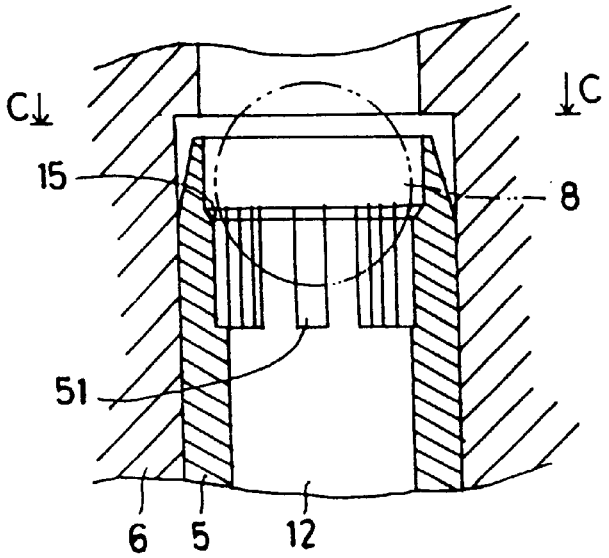
FIG. 9B
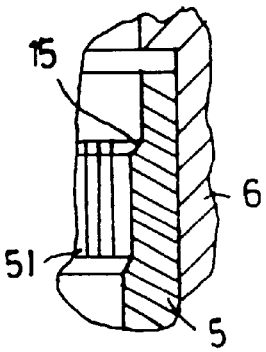
FIG. 9C
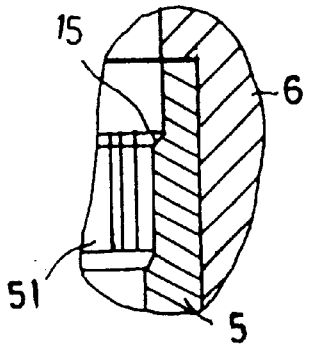
FIG. 9D

FIG. 10A
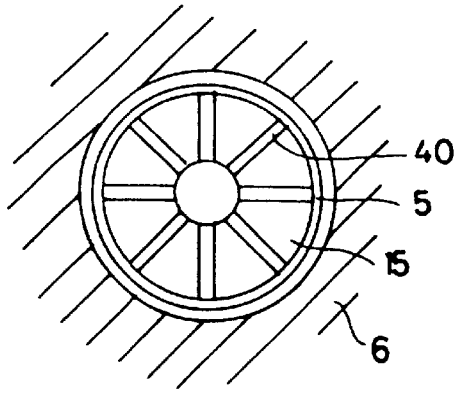
FIG. 10B
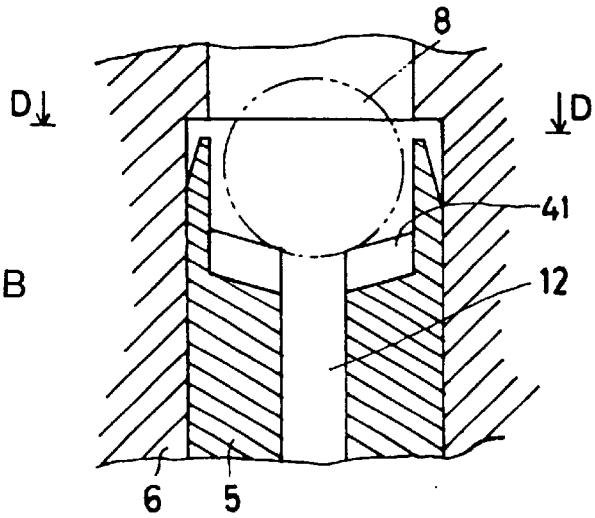
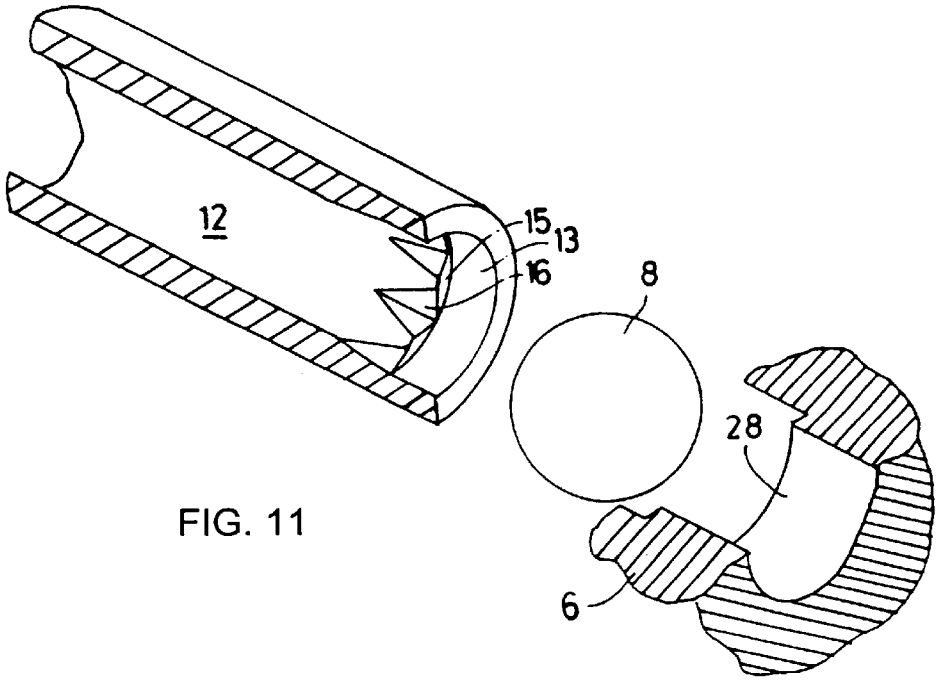
FIG. 11

FIG. 12A
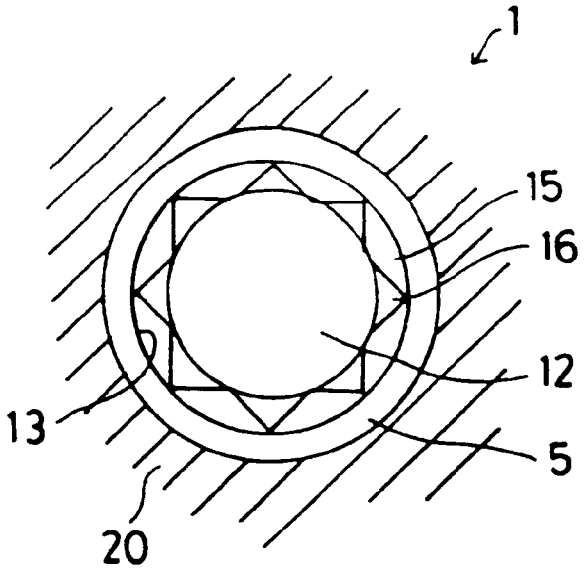
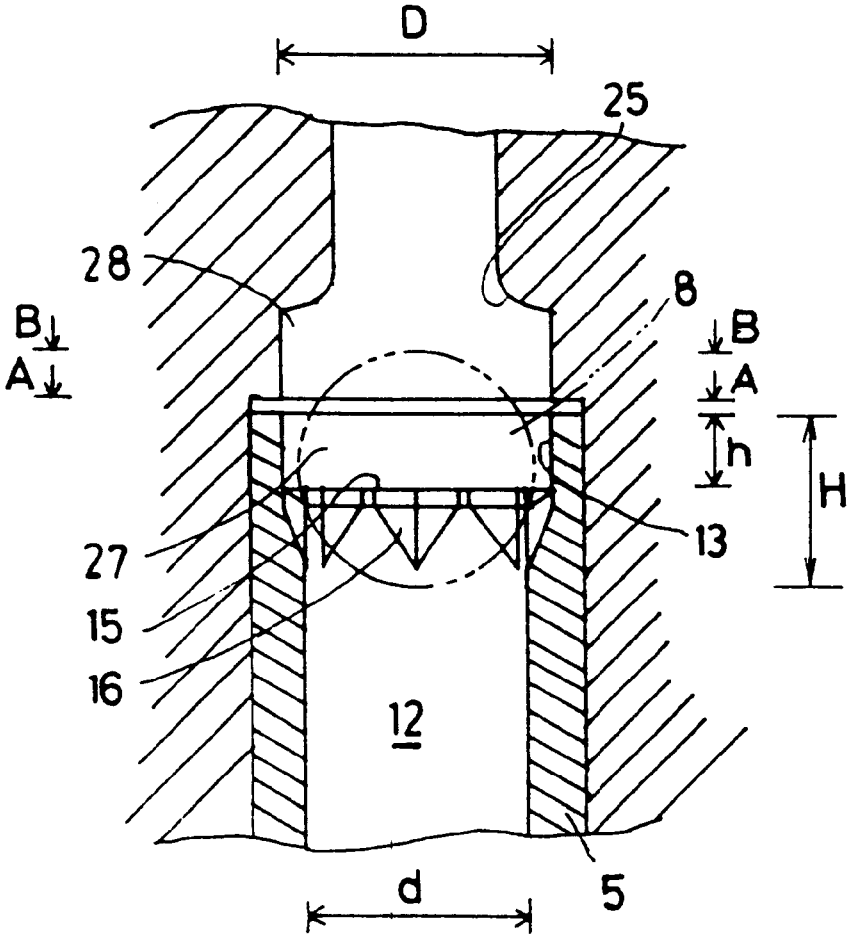
FIG. 12B

FIG. 13A
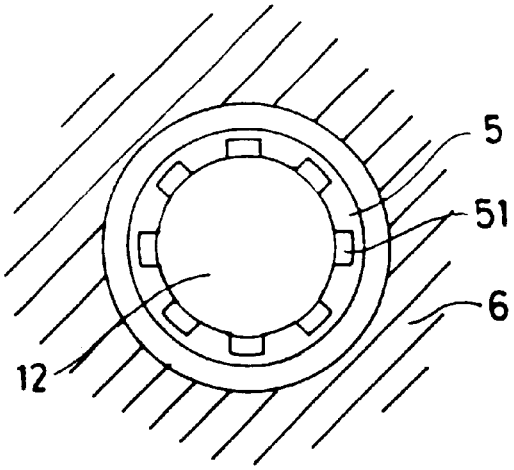
FIG. 13B
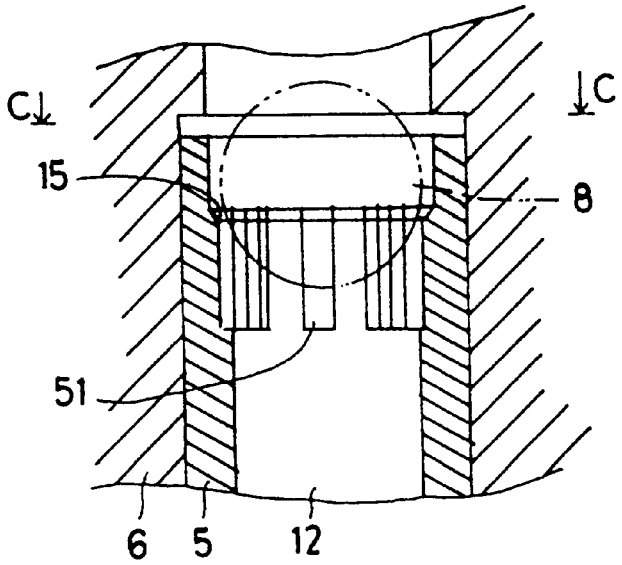
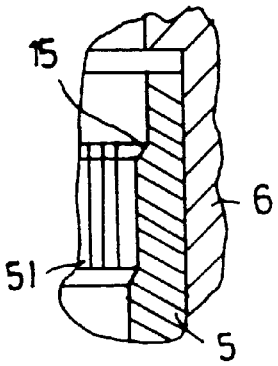
FIG. 13C
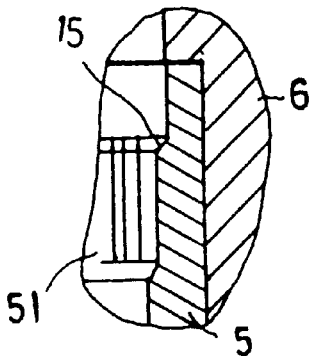
FIG. 13D

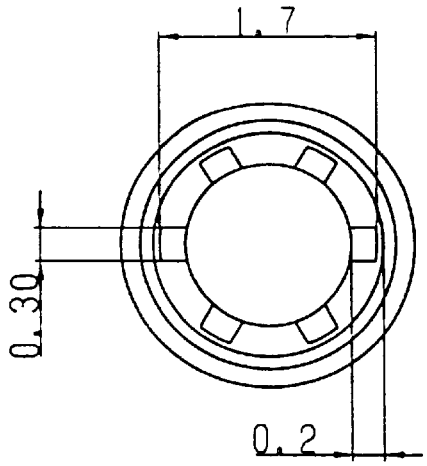
FIG. 18A
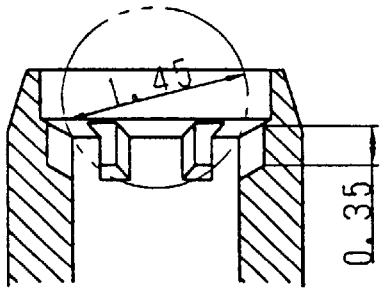
FIG. 18B
FIG. 19A
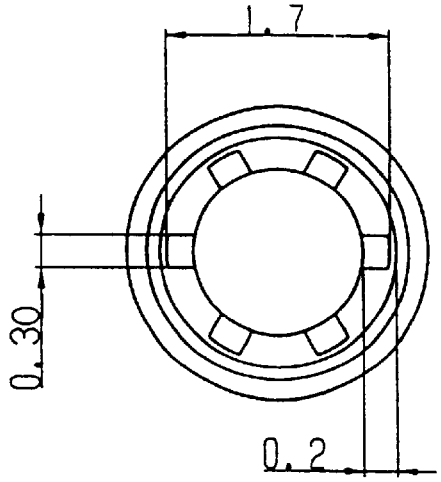
FIG. 19B
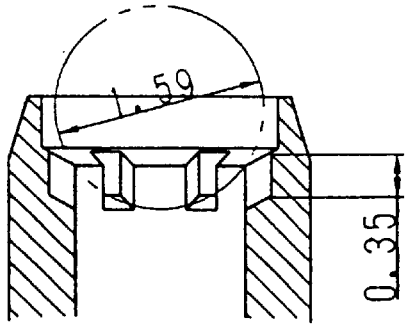

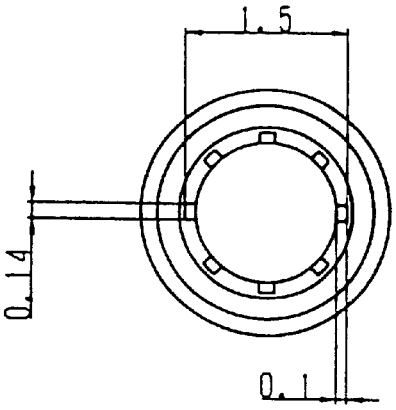
FIG. 20A
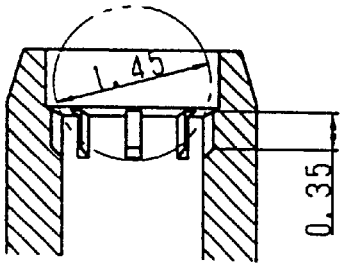
FIG. 20B
FIG. 21A
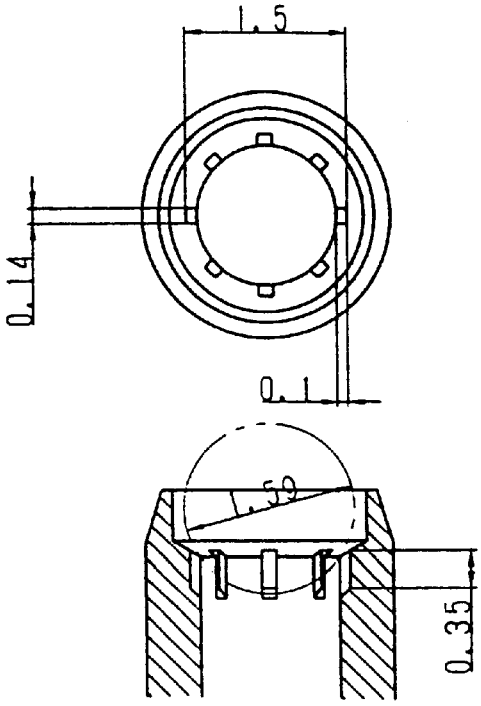
FIG. 21B

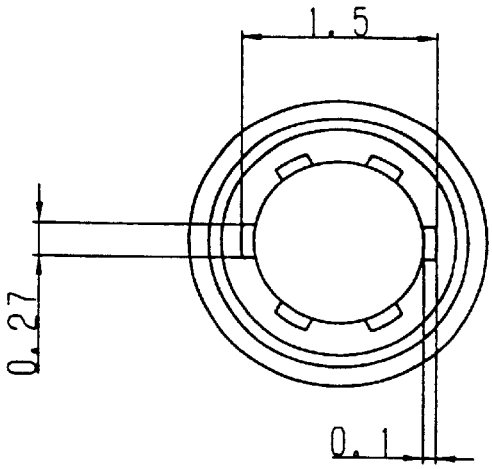
FIG. 22A
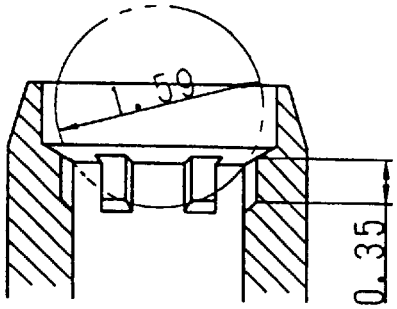
FIG. 22B
FIG. 23A
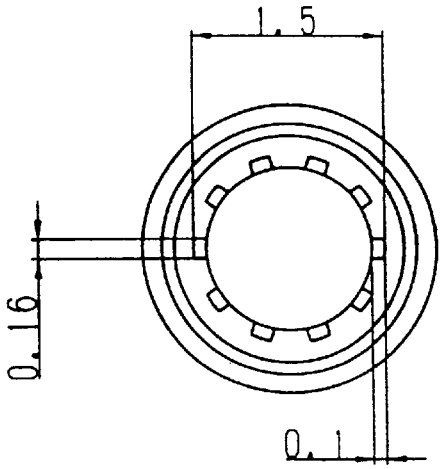
FIG. 23B
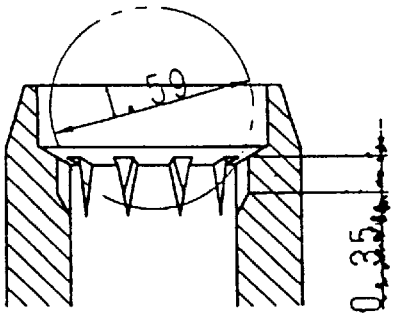

INK APPLICATOR, INK BACKFLOW PREVENTION MECHANISM OF INK APPLICATOR, AND A PEN TIP

FIELD OF THE INVENTION

The present invention relates to an applicator such as a ball-point pen or the like. Particularly, the present invention provides a structure suitable to constitute the applicator like the ball-point pen which contains an aqueous ink of various types or more particularly an aqueous ink of a considerably high viscosity.

The term "aqueous inks" used hereinafter generally denotes "inks each containing water or a water-soluble organic solvent" in comparison with "oily inks".

BACKGROUND OF THE INVENTION

Typically, the conventional ball-point pens have oily inks filled therein. However, some novel types of ball-point pens containing aqueous inks instead of the oily inks have recently developed, wherein the aqueous inks are less viscous than the oily inks. The flow rate of the aqueous inks effluent from such novel type ball-point pens is high enough to ensure the drawing of thicker lines, but these pens are likely to cause the problem of "scratchy lines or blurred strokes".

This problem results from the fact that a ball-retaining cavity in each of those novel type ball-point pens can not necessarily hold therein a sufficient amount of an aqueous ink less viscous than the oily inks. If the novel type ball-point pens are left for a while to take their upside down position where penpoint tips face upwards, then a considerable amount of the ink will flow down into an ink reservoir from the ball-retaining cavity. Therefore, the ball-retaining cavity will become almost empty to render scratchy or blurred the first strokes or lines.

Some improvements proposed to incorporate check valves to resolve the problem of such a backflow of the ink are disclosed in:

Japanese Patent Publication No. Sho. 28-717,

Japanese Utility Model Publication No. Sho. 54-15703, ibid. 54-15704,

Japanese Utility Model Laying-Open Gazette No. Sho. 62-30684,

Japanese Utility Model Publication No. Hei. 4-52067,

Japanese Utility Model Laying-Open Gazette No. Hei. 6-64956, and ibid. 6-83376.

The Japanese Utility Model Publication No. Hei. 4-52067 is regarded as the most typical one, and the structure of ball-point pen disclosed therein will be discussed below.

FIGS. 25(*a*) and 25(*b*) are cross-sectional views of the ball-point pen shown in this publication and comprising a built-in valve.

A ball-point pen 100 shown in the publication 4-52067 comprises a pen-handle 101 and an ink core 102 inserted therein. The ink core 102 consists of a penpoint tip (a.k.a. 'nib') 105, an ink reservoir 106, a connector 107 and a valve body 108. The penpoint tip 105 has a writing ball 109 installed therein. The ink reservoir 106 is a cylindrical member to hold therein an aqueous ink. The connector 107 connects the penpoint tip 105 to the ink reservoir 106 and has a bore 110 communicating therewith. A valve seat 111 and lugs 113 are formed in and integral with the bore 110.

The penpoint tip 105 is fitted in a distal end of the connector 107, with the ink reservoir 106 being fitted thereon.

The prior art ball-point pen 100 has a valve chamber 115 defined between the valve seat 111 and the lugs 113, within the bore 110 of the connector 107.

If and when this prior art pen 100 takes a position where its penpoint tip 105 faces upwards, then the valve body 108 will contact and rest on the valve seat 111 in a manner shown in FIG. 25(*a*). Consequently, a central opening through the valve seat 111 will be stopped so as to prevent the ink in the penpoint tip 105 from flowing backward therefrom.

However, the penpoint tip 105 may be positioned to face down-wards so that the valve body 108 leaves the seat 111, then engages with and stands still on the lugs 113 as shown in FIG. 25(*b*). The ink in the reservoir 106 will thus move towards the penpoint tip 105, flowing through gaps that exist between the valve body 108 and the lugs 113.

In the prior art ball-point pen 100, its spherical valve body 108 is movable fore and aft within the valve chamber 115, in response to whether the pen stands upright or whether reversed upside down. Thus the ink is permitted to flow forward towards the penpoint tip 105, but is inhibited from flowing backward towards the ink reservoir 106. This structure will diminish the problem of "scratchy first strokes".

In the pen 100 known in the art, an inner periphery of the bore 110 extending through the connector 107 serves as a peripheral wall of the valve chamber 115. Unfavorably, it is difficult for the valve chamber 115 thus formed to be of a sufficient preciseness.

In detail, the connector 107 may usually be formed by the injection molding such that the lugs 113 protruding from its inner periphery renders 'undercut' a region where the valve chamber 115 is located. Therefore, a wrenching force will unavoidably be applied to such a region of the valve chamber 115 when removing those connectors from an injection mold, thus failing to provide them with an unvarying accuracy in dimension and thereby lowering the highest possible precision.

It also is difficult to design and adopt an optimum clearance between the valve chamber 115 and the valve body 108 in such a prior art ball-point pen 100. If the clearance is too small, then the valve body 108 moving within said chamber will sometimes be stopped therein at an intermediate position. In a case wherein the clearance is too large, the valve body 108 will possibly rock transversely and undesirably fail to rest tightly on the valve seat 111.

The other prior art ball-point pens likewise suffer from the same or similar problems. In each of the ball-point pens known from the Publications or Gazettes listed above, an internal surface of the connector is utilized as the periphery of the valve chamber. This will result in a lower dimensional accuracy of the valve chambers thus formed. Accordingly, there will be involved a difficulty in predetermination of an appropriate clearance between each valve chamber and the valve body, thus failing to ensure smooth motion of the valve body.

In view of the problems inherent in the prior art, a primary object of the present invention is to provide a ball-point pen such that its valve chamber is formed with an epoch-making accuracy in dimension and such an improved accuracy will in turn enable optimization of the clearance between a valve body and the valve chamber, whereby the valve body thus rendered capable of moving more smoothly will afford a smoother hand-writing.

DISCLOSURE OF THE INVENTION

The present inventors have made various researches and studies to achieve the object just described above, and from a fundamental aspect of the present invention, it now provides a structure such that a penpoint tip has a region of an increased inner diameter for receiving a valve body partially or wholly, as disclosed in our basic patent application (No. Hei.9-349938) filed with the Japanese Patent Office. The ball-point pen provided herein from the fundamental aspect does comprise the penpoint tip having a distal end in which a writing ball is secured and having an ink-feeding bore extending through and axially of the penpoint tip, an ink reservoir for holding therein an amount of an ink, a connector for connecting the pen-point tip to the reservoir, a communicating bore formed through the connector so as to communicate with both the ink reservoir and the penpoint tip, and a valve seat formed in the communicating bore such that a valve body moving axially of the pen is allowed to rest on and engage with the valve seat. This ball-point pen is characterized in that the penpoint tip has an increased-inner-diameter region that is formed in and adjacent to an opening of the ink-feeding bore and located in the connector so that the valve body is capable of transferring partially or wholly into the ink-feeding bore, and that the ink-feeding bore has an engagement portion capable of engaging with and stopping the valve body in such a manner that interstice(s) for passage of the ink is provided between the engagement portion and the valve body, whereby with the penpoint tip facing upwards, the valve body will tightly rest on the valve seat so as to prevent the ink from flowing backward, whilst the valve body moves partially or wholly into the ink-feeding bore and engages with the engagement portion so as to allow the ink to flow through the interstice(s) towards the writing ball if the penpoint tip is held in position to face downwards.

In the ball-point pen just mentioned above, a proximal end of the penpoint tip serves as one of parts defining a valve chamber.

In summary, in this ball-point pen the increased-diameter region is disposed in and close to the ink-feeding bore's opening confronting the connector so that the valve body can move in part or fully into said region. The engagement portion for engaging with and stopping the valve body is also formed in the ink-feeding bore, so that the valve body can move between the valve seat formed in the connector's communicating bore and the engagement portion formed in the ink-feeding bore. Thus, the ink-feeding bore serves per se also as a part of valve chamber. In more detail, the increased-diameter-region and the engagement portion provided in the preceding invention of ours do function as the parts defining the valve chamber.

Generally, the penpoint tips are manufactured by the cutting or the like machining technique so that an achievable degree of precision is much higher than in the case of forming the connectors. Thus, the increased-diameter-regions can be formed highly accurately in the penpoint tips such that a proper clearance may be provided for each valve body.

Also from the fundamental aspect, interstice(s) will appear between the valve body and the engagement portion engaging with and stopping same. Consequently, the ink flows through the interstice(s) towards the writing ball though the valve body engages with the engagement portion, whenever the penpoint tip is positioned to face downwards.

From a revised or innovated aspect of the present invention, an improvement is provided such that the penpoint tip is received in the connector's communicating bore, and a region thereof intervening between the seat and the tip's proximal end has characteristically an inner diameter substantially equal to that of said tip's increased-diameter region.

In this improvement, the inner diameter of a portion of peripheral surfaces defining the valve chamber and belonging to the connector is made substantially the same as that of the increased-diameter-region of the penpoint tip so that the valve body can move more reliably. In other words, the difference in inner diameter between the connector and said increased diameter region is diminished to eliminate any obstacle or barrier that would hinder the valve body from smoothly displacing itself.

Preferably, the valve body may be a spherical article.

Also preferably, the engagement portion for the valve body may be formed as an annular stepping zone (viz., an annular shoulder) that is disposed at a boundary between the increased-diameter region and the remaining regions of the ink-feeding bore. Grooves that may be engraved in the stepping zone will serve as the interstice(s) through which the ink flows.

The annular stepping zone is a peripheral wall portion that may either be of a rectangular shape or of an oblique shape.

Preferably a plurality of such grooves engraved in the stepping zone may be triangular, circular or tetragonal in cross section, insofar as they allow the increased-diameter-region to communicate with the other region where the writing ball is disposed in the ink-feeding bore.

As discussed above, the proximal end and more particularly the increased-diameter region thereof of the penpoint tip is utilized as one of parts constituting the valve chamber in the ball-point pen. By virtue of this feature, an optimum clearance can be designed and employed for the valve body, and the latter can move smoothly and the ink inhibited from flowing backwards will smoothly advance towards the writing ball.

As already discussed above, the aqueous inks are generally less viscous than the oily inks. However, a considerable difference is observed between individual aqueous inks due to the difference in additives contained in them. In a case wherein the ball-point pen summarized above is used with an ordinary one of such aqueous inks, smooth flow of the ink will afford a good writing condition. More viscous ones of those aqueous inks will however be transferred onto a paper not smoothly but scratchily.

For example, metallic color inks (containing considerable amounts of metal powders), double-color-developing inks, titanium oxide (usually 'dioxide')-containing inks and inks containing considerable amounts of peal-like-glossy pigments will often render blurred or scratchy the written characters, disabling a high speed writing.

This problem is considered to be caused by the phenomenon that it is difficult for such a viscous ink to flow through the cut grooves whose inner edges are in contact with the valve body.

It may be expected that the cut grooves (viz., interstices) could be enlarged in cross section for more fluent passage of the ink in order to avoid the blurring or scratching of the written characters. However, size of the valve bodies in the applicators such as the ball-point pens will also affect the actual flowability of inks, and it has not been known yet what a large cross-sectional area of each cut groove (interstice) will assure a sufficient flow rate of the inks. Further, difficulty in machining the cut grooves (interstices) has been making it impossible to increase the cross-sectional area of each cut groove to an unlimited extent. In detail, in manufacture of those penpoint tips, a chuck is used to grip one end of a length of wire-like raw material while providing a bore as the ink-feeding bore is formed therethrough, before forming the cut grooves as the interstices, using the broaching technique. In more detail, a broach will be forced into the bore axially of the wire length in order to machine the grooves. Thrust urging inwardly and axially the broach is thus born directly by the chuck which merely seizes the wire length at its periphery, although the chuck can not usually withstand an unlimitedly strong thrust. If the chuck is fastened with an excessive pressure on such a wire-like and considerably soft raw material, then the latter will be injured. If contrarily the chuck is operated to exert a moderate pressure to the raw material, then the chuck will slip along the latter, resulting an extremely insufficient precision of the cut grooves. Due to these problems, the cut grooves (interstices) could not have been rendered large enough in their cross section.

From a further revised or innovated aspect, the present invention provides an applicator developed to resolve the drawbacks mentioned above and comprising an ink reservoir, an ink-dispensing penpoint tip and a valve mechanism, wherein the mechanism comprises a valve body movable in directions in which an ink flows, a valve seat disposed upstreamly of the valve body and adjacent to the ink reservoir, and a valve support disposed downstreamly of the valve body and adjacent to the ink-dispensing or penpoint tip. The valve support capable of coming into engagement with the valve body is designed such that interstices are provided between them for passage of the ink. In operation, the valve body will rest on the valve seat so as to inhibit the ink from flowing backwards if and while the tip of said applicator stands facing upwards, whereas the valve body will rest on the valve support to permit the ink to flow through the interstices and towards the tip if and while the tip faces downwards. The applicator provided herein is characterized in that the valve body's portion contacting the valve support is spherical in shape, and that in a projection of the valve body and the interstices made onto a plane perpendicular to the direction in which the ink flows such an interstice region as not hidden with the valve body has a total area of at least 0.035 $mm^2$.

The wording "area of the interstice region not hidden with the valve body in a projection of the valve body and the interstices, with the projection being made onto a plane perpendicular to the direction in which the ink flows" mentioned above denotes the area of the interstice region(s) in a parallel-projected figure of the valve body 8 and the valve support 15 (viz., a structural element for engagement with the valve body), wherein said region(s) protrude outwards from a contour of the valve body 8 as shown in FIG. 2(*b*). Such protruding or jutting region(s) are indicated by the hatchings in FIG. 2(*b*). If such an area is 0.035 $mm^2$ or more in the projection, then the ink will move through the interstices towards this applicator's tip at a sufficient flow rate not causing any defect of 'scratching or blurring'. If contrarily the area is less than 0.035 $mm^2$, then the ink would likely clog the interstices, resulting in 'scratched or blurred' handwritten characters or the like.

The critical effect of such a projectional area has been found through experiments done by the present inventors. Although theoretical studies have not yet been completed, we suppose as follows. Namely, the ink will be forced to flow along the spherical surface of the valve body so as to suffer from a resistance that hinders the ink from moving towards the tip through the interstices, notwithstanding a relatively large size thereof, in the event that said interstices were hidden entirely with the valve body in the projection.

From another aspect of the present invention made to resolve the already discussed problems, it provides a ball-point pen comprising a penpoint tip having a distal end in which a writing ball is secured and having an ink-feeding bore extending through and along an axis of the penpoint tip, the pen further comprising: an ink reservoir for holding therein an amount of an ink, a connector for connecting the penpoint tip to the reservoir, a communicating bore formed through the connector so as to communicate with both the ink reservoir and the penpoint tip, and a valve seat formed in the communicating bore such that a valve body moving axially of the pen is allowed to rest on and engage with the valve seat. This ball-point pen is characterized in that the penpoint tip has an increased-inner-diameter region that is formed in and adjacent to an opening of the ink-feeding bore and located in the connector so that the valve body is capable of transferring partially or wholly into the ink-feeding bore, and that the ink-feeding bore has an engagement portion capable of engaging with and temporarily stopping the valve body in such a manner that interstices for passage of the ink is provided between the engagement portion and the valve body, whereby with the penpoint tip facing upwards, the valve body will tightly rest on the valve seat so as to prevent the ink from flowing backward, whilst the valve body moves partially or wholly into the ink-feeding bore and engages with the engagement portion so as to allow the ink to flow through the interstices towards the writing ball if the penpoint tip is held in position to face downwards. More characteristically, the ball-point pen is further characterized in that in a projection of the valve body and the interstices made onto a plane perpendicular to the axis of the penpoint tip, such an interstice region as not hidden with the valve body has a total area of at least 0.035 $mm^2$.

Preferably, the penpoint tip may be formed of a metal, with the interstices being provided as grooves whose cut area is at greatest 0.40 $mm^2$ in total.

The cut area of the grooves is defined as an area in a projection of them made onto a plane perpendicular to the penpoint tip's axis, with the valve body being removed for convenience of doing the projection. If this area is designed to exceed 0.40 $mm^2$, then the chucking of a raw material would be rendered very difficult when broaching same.

Desirably, the cut grooves constituting the interstices may each have in the direction of ink flow a length greater than a width of said groove.

The words 'width of each groove' is a dimension measured circumferentially of the valve support. Another dimension measured of each groove radially of said support will hereinafter be referred to as 'depth' of said groove.

Shorter cut grooves will make it difficult for the ink to flow through said grooves, failing to provide non-scratched or non-blurred written characters. The cut grooves whose length is greater than their width will however render the pen free from this problem, and ensuring a high speed writing.

The valve body may desirably be a sphere, because a spherical valve body is easy to manufacture and capable of rotating about its center to facilitate the ink to flow smoothly.

In a case wherein the penpoint tip is made of a material susceptible to magnetization, it is desirable to form the valve body of a substantially nonmagnetic material. The latter material may be any of those which in one case perfectly protect the valve body from magnetic attraction to the penpoint tip, and which in another case weakly magnetize said body to stick to said tip to such a degree as being readily removable therefrom. For example, austenitic stainless steels, ceramics, copper alloys and glasses are included in the non-magnetic materials.

Where the penpoint tip is temporarily or otherwise in a magnetized state, the valve body of a magnetic material will firmly stick to said tip. In such an event, said valve body would not descend towards the valve seat even if the penpoint tip is raised above the pen's remaining portions, thus disabling the backflow prevention mechanism. In contrast, the valve body of a non-magnetic material will not cause such a problem.

The relatively high-viscous inks mentioned hereinbefore may be of a viscosity falling within a range from 1000 to 10000 mPa·s measured with the so-called "ELD-type" viscometer, using a cone of 3° (R14) rotating at a speed of 0.5 rpm at 20° C.

The present invention just summarized above will be most effective in particular for an ink containing pigments whose average particle diameter is from 5 to 30 $\mu$m.

Also effective is the present invention in cases of employing any of the metal powder-containing inks, double-color-developing inks, titanium dioxide-containing inks and/or pearl-glossy pigments-containing inks.

If the inks each contain a considerable amount of a thickener for raising viscosity of the ink, the present invention will still be especially useful.

The present invention is especially effective if the viscosity-raising thickener is a thixotropic polysaccharide or its derivative.

In particular, the applicator whose ink contains the polysaccharides produced by some microbes will have good writing properties.

The present invention is extremely effective if the inks contain 'rhamsan' gums. The rhamsan gums will function principally as a thickener for raising viscosity of any ink so that durability or pot life of aluminum-pig-ment-containing inks is improved noticeably.

From still another aspect of the present invention that was made to resolve the already discussed problems, it provides a penpoint tip adapted for use with a spherical valve body and a connector, the tip having a distal end in which a writing ball is secured and having an ink-feeding bore extending through and along an axis of the penpoint tip, the tip further comprising an increased-inner-diameter region that is formed in and adjacent to an opening of the ink-feeding bore and located in the connector so that the valve body is capable of transferring partially or entirely into the ink-feeding bore. This bore has an engagement portion capable of engaging with and temporarily stopping the valve body in such a manner that interstices are provided between the engagement portion and the valve body, and the penpoint tip is characterized in that in a projection of the valve body and the interstices made onto a plane perpendicular to the axis of the pen point tip, such an interstice region as not hidden with the valve body has a total area of from 0.035 $mm^2$ to 0.40 $mm^2$.

BRIEF DESCRIPTION OF THE DRAWINGS

FIG. 1 is a cross section of a ball-point pen provided in an embodiment of the present invention;

FIG. 2(*a*) is a perspective view of a distal end of a penpoint tip incorporated in the pen shown in FIG. 1;

FIG. 2(*b*) is a side elevation of the penpoint tip shown in FIG. 2(*a*);

FIG. 3 is a perspective view of the distal end of the penpoint tip illustrated together with a valve body and a proximal end of a connector, that are all included in the ball-point pen of FIG. 1 and shown partly in cross section;

FIG. 4 is an enlarged cross section of a junction where the penpoint tip is secured to the connector;

FIG. 5 is a cross section taken along the line A—A in FIG. 4;

FIG. 9(*a*) is an enlarged cross section taken along the line C—C in FIG. 9(*b*);

FIG. 9(*b*) is a side-elevational cross section of a junction where the penpoint tip is secured to the connector in another embodiment of the present invention;

FIGS. 9(*c*) and 9(*d*) are enlarged cross sections of modified junctions;

FIG. 10(*a*) is an enlarged cross section taken along the line D—D in FIG. 10(*b*);

FIG. 10(*b*) is a side-elevational cross section of a junction where the penpoint tip is secured to the connector in still another embodiment of the present invention;

FIG. 11 is a perspective view of the distal end of the penpoint tip illustrated together with a valve body and a proximal end of a connector, that are all included in the ball-point pen of yet still another embodiment and shown partly in cross section;

FIG. 12(*a*) is an enlarged cross section taken along the line A—A in FIG. 12(*b*);

FIG. 12(*b*) is a side-elevational cross section of a junction where the penpoint tip is secured to the connector in the yet still another embodiment;

FIG. 13(*a*) is an enlarged cross section taken along the line C—C in FIG. 13(*b*);

FIG. 13(*b*) is a side-elevational cross section of a junction where the penpoint tip is secured to the connector in a further embodiment of the present invention;

FIGS. 13(*c*) and 13(*d*) are enlarged cross sections of modified junctions;

FIG. 14(*b*) is a side-elevational cross section of a junction where the penpoint tip is secured to the connector in a still further embodiment of the present invention;

FIG. 15(*b*) is a side-elevational cross section of a junction where the penpoint tip is secured to the connector in a yet still further embodiment;

FIG. 16(*b*) is a cross section taken along the line E—E;

FIG. 17(*b*) is a cross section taken along the line E—E;

FIG. 18(*a*) is a side elevation of a penpoint tip used in Example 3;

FIG. 18(*b*) is a cross section taken along the line E—E;

FIG. 19(*a*) is a side elevation of a penpoint tip used in Example 4;

FIG. 19(*b*) is a cross section taken along the line E—E;

FIG. 20(*a*) is a side elevation of a penpoint tip used in Reference 1;

FIG. 20(*b*) is a cross section taken along the line E—E;

FIG. 21(*a*) is a side elevation of a penpoint tip used in Reference 2;

FIG. 21(*b*) is a cross section taken along the line E—E;

FIG. 22(*a*) is a side elevation of a penpoint tip used in Reference 3;

FIG. 22(*b*) is a cross section taken along the line E—E;

FIG. 23(*a*) is a side elevation of a penpoint tip used in Reference 4;

FIG. 23(*b*) is a cross section taken along the line E—E;

FIG. 24(*b*) is a cross section taken along the line E—E;

FIG. 25(*b*) also is a cross section of the prior art pen reversed upside down.

BEST MODES OF CARRYING OUT THE INVENTION

Figure 6:
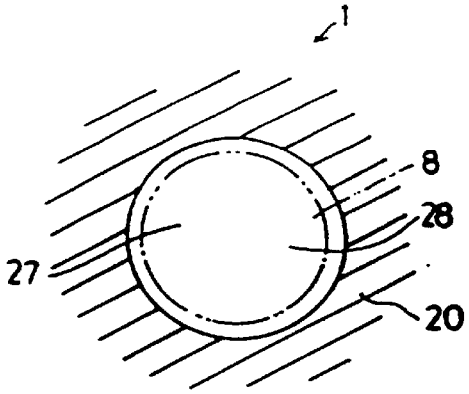
FIG. 6 is a cross section taken along the line B—B in FIG. 4.

Now, the best modes of carrying out the present invention will be described below in detail and making reference to the accompanying drawings.

In FIGS. 1 to 8, the reference numeral 1 denotes a ball-point pen provided in an embodiment of the present invention. A cylindrical pen handle 2 and an ink core 3 constitute this ball-point pen 1 as in the prior art ones. The ink core 3 consists of a penpoint tip 5, a connector 6, an ink cylinder (viz., ink reservoir) 7 and a spherical valve body 8.

Details of those parts will be described below. The penpoint tip 5 has a distal end in which a writing ball 10 is secured, and may be formed by machining an elongate metal piece such as a free-machining or free-cutting steel. This steel may for example be a free-cutting stainless steel 'DSR6F' (made by the Daido Special Steels Co., Ltd.). A matrix of this stainless steel is a steel 'SUS430', and blended with this matrix are 20% of Cr and small amounts of Mo, S, Pb and Te. Similarly to the prior art ones, the penpoint tip 5 has a distal end portion of conical shape and a proximal end portion of columnar shape. An annular shoulder 19 is formed near a proximal extremity that is of a reduced diameter and tapered for easy insertion into the connector 6.

The annular shoulder 19 may be dispensed with, if so desired.

The penpoint tip is of an internal configuration as shown in FIG. 1 so that a small ball-retaining cavity is provided for accommodation of a writing ball 10. An ink-feeding bore 12 extends from this cavity to the proximal extremity of the penpoint tip.

It is an important feature of the present invention that the penpoint tip 5 has an increased-diameter region 13 disposed in and close to a proximal opening of the ink-feeding bore 12. A single piece defines the increased-diameter region 13 and at least a majority of the axial dimension of the ink-feeding bore 12. Further, a valve support 15 (viz., engagement portion) capable of engaging with and releasably stopping the valve body is formed as an annular stepping zone (biz., annular shoulder) disposed in the ink-feeding bore 12. As will be seen in FIGS. 3 and 4, the proximal portion of the ink-feeding bore 12 is of a diameter greater than that of other portions thereof (placed in the connector). The inner diameter 'D' of such an increased-diameter region 13 may be about 70% to about 150% of the diameter of the valve body 8. More preferably, the diameter 'D' is designed to fall within a range from about 110% to 150%. The preferable lower limit '110%' ensures that the valve body 8 is received by half a volume or more in the increased-diameter region 13. A diameter 'D' exceeding 150% will undesirably render excessively large a clearance defined around the valve body and between same and the increased-diameter region 13.

It is recommended that a length or depth 'h' of the increased-diameter region 13 is from about 30% to 90% of the diameter of the valve body 8.

An inner diameter 'd' of the other portions, i.e., a principal body portion, of the ink-feeding bore 12 is preferably from about 70% to 90%, where seen from the proximal end thereof.

The valve support 15 of a shape like an inner and annular shoulder may either be perpendicular to or slanted relative to inner periphery of the increased-diameter region 13. In the latter case, the bore is coneshaped if seen from the proximal end thereof. Although in an illustrated example of the ball-point pen 1 the valve support 15 is oblique relative to said region's inner periphery by about 120°, this angle may be changed within a range of about 110° to 130°.

Summarizing, a relationship between the portions of increased-dia-meter region 13 in their shape and dimension has to be such as to guaranteeing that the valve body 8 be permitted to fit in part in said region 13.

An extent to which the valve body 8 will sink into the increased-diameter region 13 has to be more than a hemisphere beyond the 'equator' if the body were regarded as a virtual 'earth'. Thus, the distance 'H' (see FIG. 4) which the valve body 8 advances into the region may be designed to be 50% or more of the body's diameter, and more preferably 60% to 100%.

Such a sinking distance 'H' of the valve body 8 may however be altered to be about 40% or to be about 120%. In the latter case, the valve body 8 will 'soak' itself more than entirely in the increased-diameter region 13, whilst in the former case of the body sinking shallower short of 'equator' its displacement into the region will advantageously be finished more quickly.

In any case, the valve body 8 which has entered the increased-diameter region 13 must be in contact with the valve support 15 in part so as not to further move towards the distal end. In this state of these members, the clearance for an ink stream should appear between the body 8 and the inner periphery of said region 13.

Figure 7:
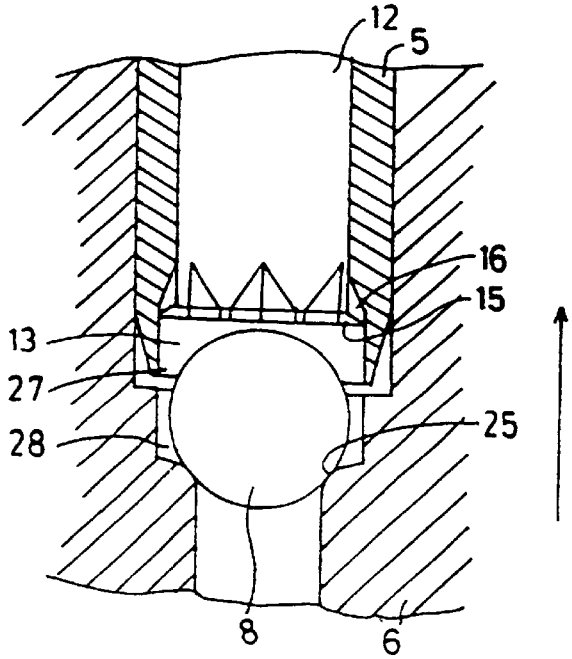
FIG. 7 is an enlarged cross section of the junction where the penpoint tip is secured to the connector, wherein the tip faces upwards.

Another important feature resides in that cut grooves 16 (serving as the interstices) are formed in the valve support 15. In the present embodiment, each of eight cut grooves 16 is of a triangular and elongate shape with radially facing surfaces as seen in FIGS. 3 to 5 and they are arranged at regular angular intervals. Length in axial direction of each groove 16 is about one third of the diameter of the valve body 8, as seen in FIG. 4 or 7. Depth of each groove 16 gradually decreases from the increased-diameter region 13 towards the writing ball 10.

The connector 6 is made by injection molding a thermoplastic resin such as a polypropylene and is of an appearance similar to that of the prior art connectors. A distal end portion of the connector 6 is of a conical shape, and a proximal region of this connector consists of a larger-diameter cylinder 21 and a smaller-diameter cylinder 22 step-wise continuing thereto towards the proximal end.

A communicating bore 23 axially penetrates the connector 6 so as to extend along a center line thereof.

A valve seat 25 is formed in the communicating bore 23, at an intermediate location thereof The valve seat 25 is similar to the prior art ones in shape and dimension, and a positioning annular shoulder 31 is formed in a distal portion of the bore 23.

A characteristic feature of the connector 6 resides in the configuration of inner periphery of the communicating bore 23. A relatively-small-diameter region 28 of said periphery is disposed downstreamly of the valve seat 25, and inner diameter of said region 28 is equal to that of the increased-diameter region 13 of the penpoint tip 5.

More exactly, the position of such a relatively-small-diameter region 28 is such that it will intervene between the proximal end of the inserted penpoint tip 5 and the valve seat 25.

The valve body 8 is a sphere made of a material such as a stainless steel, a hard metal or a ceramics that are rust-resisting and of a considerable specific gravity.

It is preferable that the valve body 8 is formed of a non-magnetizable material for the following reasons.

The penpoint tips 5 are usually prepared by machining a free-cutting stainless steel to which sulfur, selenium, lead, tellurium and/or molybdenum are added. It is likely that those penpoint tips 5 formed of such a steel tend to be magnetized during the cutting process. If the valve body 8 is made of a magnetizable metal, then it will be magnetized by and attracted to the magnetized penpoint tip 5. In such an event, a non-use position of the pen whose tip 5 is located uppermost would not let the valve body fall onto the valve seat 25, thus rendering inactive the ink backflow-preventing mechanism.

The valve body 8 formed of a substantially non-magnetizable material will be effective to avoid such a problem. Even if the penpoint tip 5 remains magnetized, the valve body 8 will not be attracted to said tip but will descend therefrom to sit on the valve seat 25 due to gravitational force, protecting the ink from backflow.

The substantially non-magnetizable materials are those which cause the valve body not to stick at all to the penpoint tip, or allow said body to be weakly attracted thereto in a readily releasable manner. Those materials include austenitic stainless steels, ceramics, copper alloys and glasses.

Austenitic stainless steels are most preferable because they are not only of a higher hardness and higher specific gravity, but also easy to be manufactured into a spherical shape. All the types included in a range from SUS 201 to SUS 385 are usable, but SUS 304 and SUS 316 are the best.

The ink reservoir 7 made by extrusion of a plastics such as a polyethylene or a polypropylene is filled with an aqueous ink. A mass of such an ink has a trailing end that is closed with a sealant such as a polybutene in a gel state.

The ink core 3 comprises the penpoint tip 5 and the ink reservoir 7 that are connected by the connector 6 to each other, as shown in FIG. 1. The penpoint tip 5 is inserted in a distal region of the connector's communicating bore 23. On the other hand, the ink reservoir 7 is fitted on the smaller-diameter cylinder 22 formed as a proximal region of said connector 6. The penpoint tip 5 thus fitted in the connector will be positioned correctly by means of its outer annular shoulder 19 stopped by the connector's distal annular shoulder 31. As seen in FIG. 4, the proximal end of the penpoint tip 5 will be located in the vicinity of the relatively-small-diameter region 28 of the connector 6.

The valve body 8 accommodated in the connector 6 is displaceable therein, axially thereof and between the tip's valve support 15 and said connector's valve seat 25.

In other words, the ball-point pen 1 of the present embodiment has a space of an inner diameter greater than that of adjacent cavities. This space consists of (i) a part constituting the connector's communicating bore 23 and positioned downstreamly of the valve seat 25 and (ii) the increased-diameter region 13 of the penpoint tip 5. The part of said bore 23 and the region of said tip 5 are disposed closely to each other. Such an 'expanded' space in this embodiment is intended to function as the valve chamber 27 in the ball-point pen.

The (handle 2 of) ball-point pen 1 fits on the larger-diameter cylinder 21 as a part of the connector 6 included in the ink core 3.

The ball-point pen 1 of the embodiment will operate as follows.

If the pen takes a position such that its penpoint tip 5 tops the remainder, then the valve body 8 will come into a liquid-tight contact with the valve seat 25 as shown in FIG. 7. In this state, the ink is inhibited from flowing backwards out of the penpoint tip 5.

Figure 8:
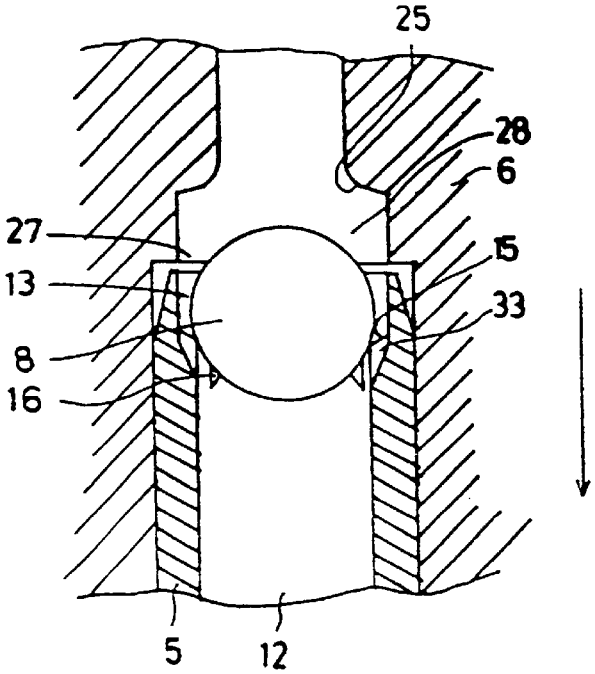
FIG. 8 also is an enlarged cross section of the junction where the penpoint, tip is secured to the connector, wherein the tip faces downwards.

If the pen 1 is positioned top over tail to write characters or so with the penpoint tip 5 facing down, then the valve body 8 will smoothly descend due to gravitational force until received in the increased-diameter region 13 of said tip 5 as shown in FIG. 8. As the connector's relatively-small-diameter region 28 located close to the rearward or proximal end of the tip 5 is of an inner diameter equal to that 'D' of the increased-diameter region 13, discontinuity in the zone transferring from the connector 6 to this region is so small that the valve body 8 having departed from the valve seat 25 can smoothly move towards said region 13. The valve body moving in this manner will subsequently have its principal part entering the increased-diameter region 13 and brought into engagement with the valve support 15 of the tip 5.

The grooves 16 cut in the valve support 15 of the penpoint tip 5 serve as interstices 33 around the valve body 8 and between same and the support 15, as will be seen in FIG. 8. An annular clearance left between the valve body 8 and the inner periphery of the increased-diameter region 13 is of a dimension sufficient for the ink to easily flow through said clearance into the penpoint tip 5, via the interstices 33, and then supplied to the writing ball 10.

As the tip 5 is raised again to face upwards after handwriting the characters or so, the valve body 8 will depart from the valve support 15 to subsequently rest on the valve seat 25 as shown in FIG. 7. This displacement of the valve body is guided by the increased-diameter region 13 of the penpoint tip 5. This region in the invention is formed by cutting the material of said tip, so that its precision in dimension is remarkably higher than those which have been provided in the prior art. Thus, an optimum clearance ensured between the region's 13 inner periphery and the valve body 8 will permit same to move to the valve seat 25 and to thereby close an opening thereof.

In the embodiment described above, the number of grooves 16 cut in the valve seat 15 of the penpoint tip 5 and serving as the interstices is 8 (eight). This number of cut grooves may however be reduced to about 4 (four), or increased to exceed 10 (ten). It is recommended to design the grooves in a manner that they provide as a large total area of the interstices as possible for the valve body 8 in contact with the valve support 15, and usually the most preferable number of those grooves may be about 8 (eight) to 10 (ten).

Each of the cut grooves may not necessarily be triangular but be tetragonal in cross section as shown at the numeral 51 in FIGS. 9(*a*) to 9(*d*) (illustrating another embodiment with a radially facing guide surface). A semicircular cross section may also be preferable in view of easiness in manufacturing the grooves. Length of each groove 51 will be designed in practice depending on the manufacturing method employed, though longer grooves are advantageous in many cases. The grooves may be quite short as shown in FIG. 4, or alternatively be much longer like those 51 in FIGS. 9(*a*) to 9(*d*). As for depth of each groove, it is desirable that the area thereof (on outlet side) seen in side elevation normal to the inner periphery of the ink-feeding bore 12 be equal to or greater than the area (on inlet side) of each groove seen in plan view of the valve support 15. Inner ends of the grooves 51 may be step-shaped as shown in FIG. 9(*b*), or tapered as shown in FIG. 9(*c*). The tapered inner ends of the cut grooves will facilitate deaeration from this region and smoothen the ink stream. Further, any excessive thrust will be relieved when machining such inner ends of the grooves, to thereby protect them from deformation. The end of each groove may desirably be tapered at a moderate angle of 90° to 120°. A more acute angle of less than 90° will possibly cause an outward swelling of the portions where the groove ends are formed.

Also for the sake of easier deaeration, the gap between the proximal end of the pen-point tip 5 and the connector 6 may desirably be eliminated as exemplified in FIG. 9(*d*). In this modification, said tip's 5 proximal end contacts the connector's portion facing same. Such a direct contact of the penpoint tip end with said connector's portion will contribute to axial positioning of them relative to each other, thereby dispensing with the annular shoulders 19 and 31.

In embodiments shown in FIGS. 9(*a*) to 9(*d*) ('another' embodiment) and in FIGS. 10(*a*) and 10(*b*) ('still another' embodiment), description of parts and members denoted with the same reference numerals as those in the first embodiment will not be repeated.

Spoke-like grooves 40 shown in FIGS. 10(*a*) and 10(*b*) are suited to a considerably thin ink-feeding bore 12 in the penpoint tip 5, since they will provide interstices between the annular shoulder and the valve body 8. If axial grooves were formed, then their openings would be closed with the valve body. In this embodiment, the valve body will indirectly abut against the annular shoulder 41, since the spoke-like grooves 40 formed and arranged therein in a radial fashion will intervene between said body 8 and shoulder.

Figure 14A:
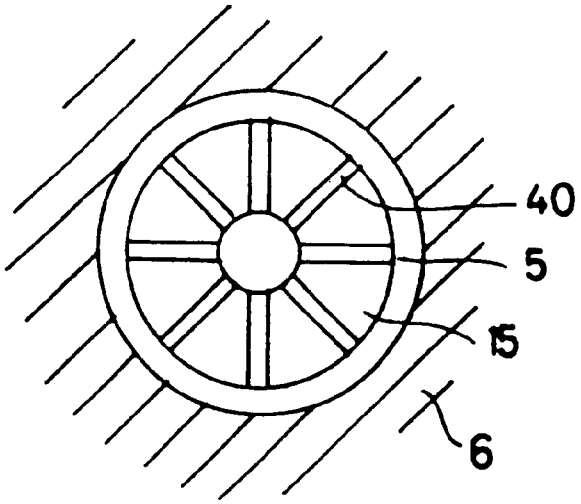
FIG. 14(*a*) is an enlarged cross section taken along the line C—C in FIG. 14(*b*)
Figure 14B:
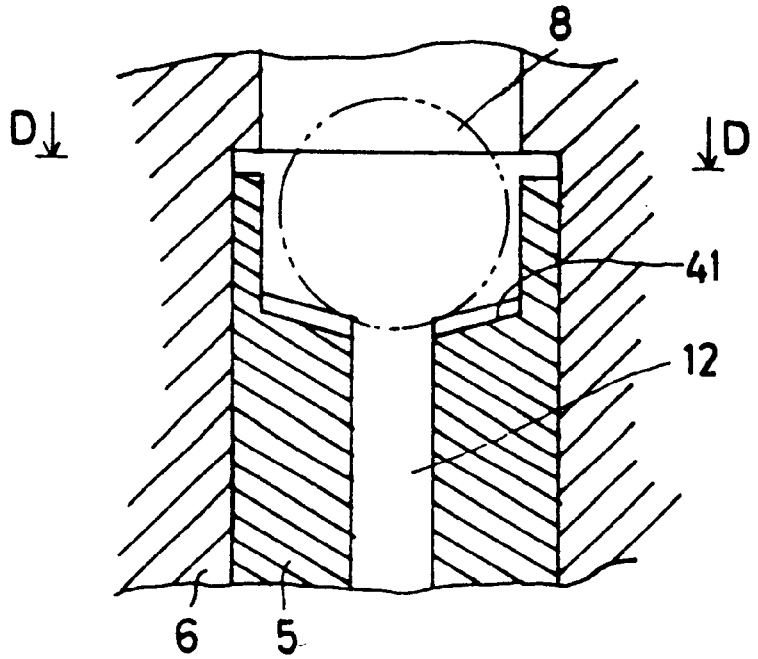

In all the embodiments already discussed above, the penpoint tips 5 have each a tapered proximal or inner end. However, their ends may alternatively be straight. FIG. 11 corresponding to FIG. 3 that illustrate partly in section and perspectively the first embodiment does show 'yet still another' embodiment wherein the penpoint tip has no tapered inner end. FIGS. 12(*a*) and 12(*b*) also showing this embodiment in cross section do respectively correspond to FIGS. 5 and 4 of the first embodiment. A 'further' embodiment also lacking in the tapered inner end of the penpoint tip 5 is shown in FIGS. 13(*a*) to 13(*d*), which correspond to FIGS. 9(*a*) to 9(*d*) because its principal features are the same as those in the 'another' embodiment. A 'still further' embodiment likewise lacking in the tapered inner end of the penpoint tip 5 is shown in FIGS. 14(*a*) and 14(*b*), which correspond to FIGS. 10(*a*) and 10(*b*) because its principal features are the same as those in the 'still another' embodiment.

It will somewhat be uneasy to insert into the connector 6 such a penpoint tip 5 having no tapered inner end, but a gap is reduced between the former's 6 inner periphery and the latter's 5 outer periphery. This is advantageous in that the problem of air stagnation in that region will be diminished.

In detail, the penpoint tips 5 provided in the embodiments shown in FIG. 1 to FIG. 10(*b*) have their inner ends so tapered that an annular gap appears between the outer periphery of each end and the inner periphery of the connector 6. Such gaps as seen in FIGS. 4, 7, 8, 9(*b*) and 10(*b*) will possibly cause air stagnation, which will in turn hinder the ink from flowing smoothly. In contrast, the other types of penpoint tips illustrated in FIGS. 11 to 14(*b*) and having non-tapered straight inner ends will not form any gap therearound but avoid air stagnation.

However it will be understood that even if the penpoint tip had a tapered inner end, direct contact thereof with the (annular shoulder of) connector will ensure a smooth stream of the ink.

A region of the inner periphery defining the communicating bore 23 in each embodiment discussed above is formed as the relatively-small-dia-meter region 28. Axial ribs may substitute for such a region 28, if they are formed integral with said inner periphery and an inscribed circle of the ribs has a diameter substantially equal to the inner diameter of the increased-diameter region 13.

Any of the known methods may be employed to process each penpoint, tip 5 to have the increased-diameter region 13 and the cut grooves 16.

For example, a semi-finished penpoint tip 5 may be subjected to a preliminary drilling with a larger-diameter drill corresponding to the inner diameter of said region 13 and then to a succeeding boring with a smaller-diameter drill corresponding to the ink-feeding bore 12. In a reversed process, this ink-feeding bore 12 will be formed at first through the semi-finished product, before enlarging an inlet opening of such a bore 12 using a larger-diameter drill or reamer corresponding to the inner diameter of said region 13.

To form the grooves 16, a cutting tool such as a broach will be introduced through an opening of the increased-diameter region and pressed to the valve support 15 so as to sever therefrom a plurality of groove-shaped small masses. To form the arrowy grooves 40 as shown in FIGS. 10(*a*) and 10(*b*), a tool whose end face has blades may be pressed to the valve support 15, similarly to the process of usually forming spoke-like grooves in a cavity for retaining a writing ball.

Next, another type of ball-point pen (in a 'yet still further' embodiment of FIGS. 15(*a*) and 15(*b*) listed above) recommended for use with some aqueous inks of considerably high viscosity will now be described. Such highly viscous inks include metallic-powder-containing inks (i.e., the so-called 'metallic inks'), double-color-developing inks, titanium-oxide-con-taining inks and pearl-glossy-pigment-containing inks and the like.

The metallic-powder-containing inks ('metallic inks') contain each as the pigment a proper amount of aluminum powder, a brass powder or the like metal powder. In such an ink, there is a noticeable difference in specific gravity between the metal pigment and a liquid ingredient or matrix (viz., vehicle), so that a suitable amount of a thickener for raising viscosity is added to the matrix so as to avoid precipitation of the pigment.

The double-color-developing inks comprise each two kinds of coloring agents. One of the agents is permeable into a surface layer or texture of an article to which the ink is applied, and the other is not permeable into the surface layer or texture. For example, each double developing ink consists of a metal pigment, a water-soluble dyestuff, water and a permeable organic solvent. When such an ink is applied to a solvent-permeable surface such as a paper or fabric to write thereon characters, symbols or figures, the metal pigment will remain on surface areas to which the ink has been applied. On the other hand, the water-soluble dyestuff will diffuse sideways through the surface layer or texture together with the solvent, thus oozing out of the contour of each applied surface area. As a result, a 'frilled' appearance of a peculiar visual effect will be given to the figures or the like drawn with this ink. A thickener for increasing viscosity of the ink is also added thereto in order to protect the dispersed metal pigment from precipitation.

Usually, white inks contain each a proper amount of titanium oxide as a pigment. This pigment is also of a comparatively high specific gravity, so that a suitable amount of a thickener is blended with the ink for preventing the pigment from depositing.

The Japanese Patent Publication No. Hei.5-46389 discloses an amount of fine particles of a high polymer is added to such a titanium oxide-containing ink, in addition to the thickener.

The pigment as an ingredient of the pearl-glossy-pigment containing ink is a fine powder of mica such that each powdery particle is coated with a metal oxide such as titanium oxide and ferrous or ferric oxide. These oxides stabilizing the dispersed mica powder are of a high refractive index affording a glossy like pearls. In detail, light beams will be reflected at boundaries each existing between a highly refractive metal oxide layer and a much less refractive mica particle and a matrix fraction surrounding same, whereby pearl-like or metal-like luster is produced. Also in these inks, the pigment has a so high specific gravity that a suitable amount of a thickener has to be blended with the ink for prevention of pigment deposition.

It is to be noted here that even the comparatively highly viscous aqueous inks mentioned above are less viscous than oily inks. Accordingly, if the penpoint tip is left facing up, the ink therein will probably flow back towards the ink reservoir, rendering empty that penpoint tip and making blurred the first strikes of handwriting.

In particular, such a blurring ink will disable a high speed writing.

A ball-point pen 50 provided in accordance with a yet still further embodiment has the same principal structure as that of the already described pen 1 with the built-in valve. The pen 50 in this further embodiment differs from that pen 1 in the preceding embodiments merely with respect to the shape of the penpoint tip's increased diameter region and engagement portion. Therefore, only these region and portion will be highlighted hereinafter, with the other parts or members being not so detailed repeatedly.

As seen in FIG. 1, the pen 50 of this embodiment comprises a cylindrical handle 2 and an ink core 3. The ink core 3 consists of, in common,with the prior art ones, a penpoint tip 5, a connector 6, an ink tube (viz., ink reservoir) 7 and a spherical valve body 8.

All the ink reservoir 7, the connector 6 and valve body 8 are the same as those which the present inventors have disclosed in their preceding application. The reservoir 7 is filled with an aqueous ink.

Formed axially through the connector 6 is a communicating bore 23 whose intermediate portion is shaped as a valve seat 25.

The spherical valve body 8 accommodated in this pen is also movable axially thereof between the valve seat 25 in the connector and a valve support 15 in the penpoint tip 5.

A material forming the valve body 8 may be a stainless steel, a hard metal, a ceramics or any other rust-resisting material of a comparatively high density. For the same reason as in the case of abovedescribed ball-point pen 1, the material may preferably be a non-magnetizable one such as any austenitic stainless steel included in a range of SUS 201 to SUS 385. The most preferable steel is SUS 304 or SUS 316.

The valve body 8, though not necessarily be spherical, is a sphere also in this embodiment and has a diameter of 1.0 to 2.0 mm and more preferably of 1.4 to 1.6 mm.

The penpoint tip 5 manufactured by machining a metal is a member having a writing ball 10 secured in a distal end of the tip. A preferable material of this tip 5 may for example be a free-cutting steel that is easy to cut, resistant to rusting and corrosion.

Appearance of the penpoint tip 5 in this embodiment is the same as that in the already discussed ball-point pen 1.

As for inner configuration of the tip 5 of the pen 50 in this 'yet still further' embodiment, its distal end portion is similar to that of the other pen 1. Thus, a ball-retaining cavity for the writing ball 10 is formed in a forward or distal end and an ink-feeding bore 12 extends therefrom towards a rearward or proximal end as seen in FIG. 1.

An increased-diameter region is formed in and adjacent to a proximal opening of the pen point tip 5. The valve support 15 (i.e., engagement portion for the valve body) formed in the ink-feeding bore 12 of this pen 50 is of a stepped shape. This shape is considerably different from that in the ball-point pen 1 of the embodiments previously described hereinbefore. There are still other differences and all the differences between them will be detailed below.

Figure 15A:
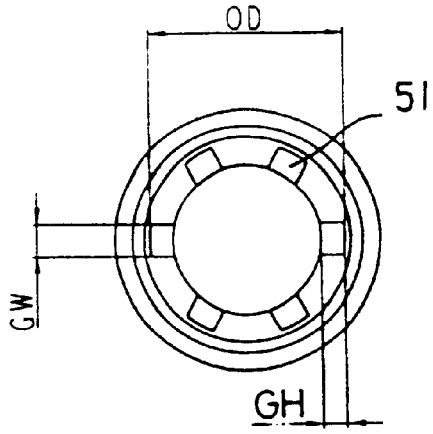
FIG. 15(*a*) is an enlarged cross section of the junction illustrated in FIG. 15(*b*), shown similarly to FIG. 9(*a*) that is taken along the line C—C in FIG. 9(*b*)
Figure 15B:
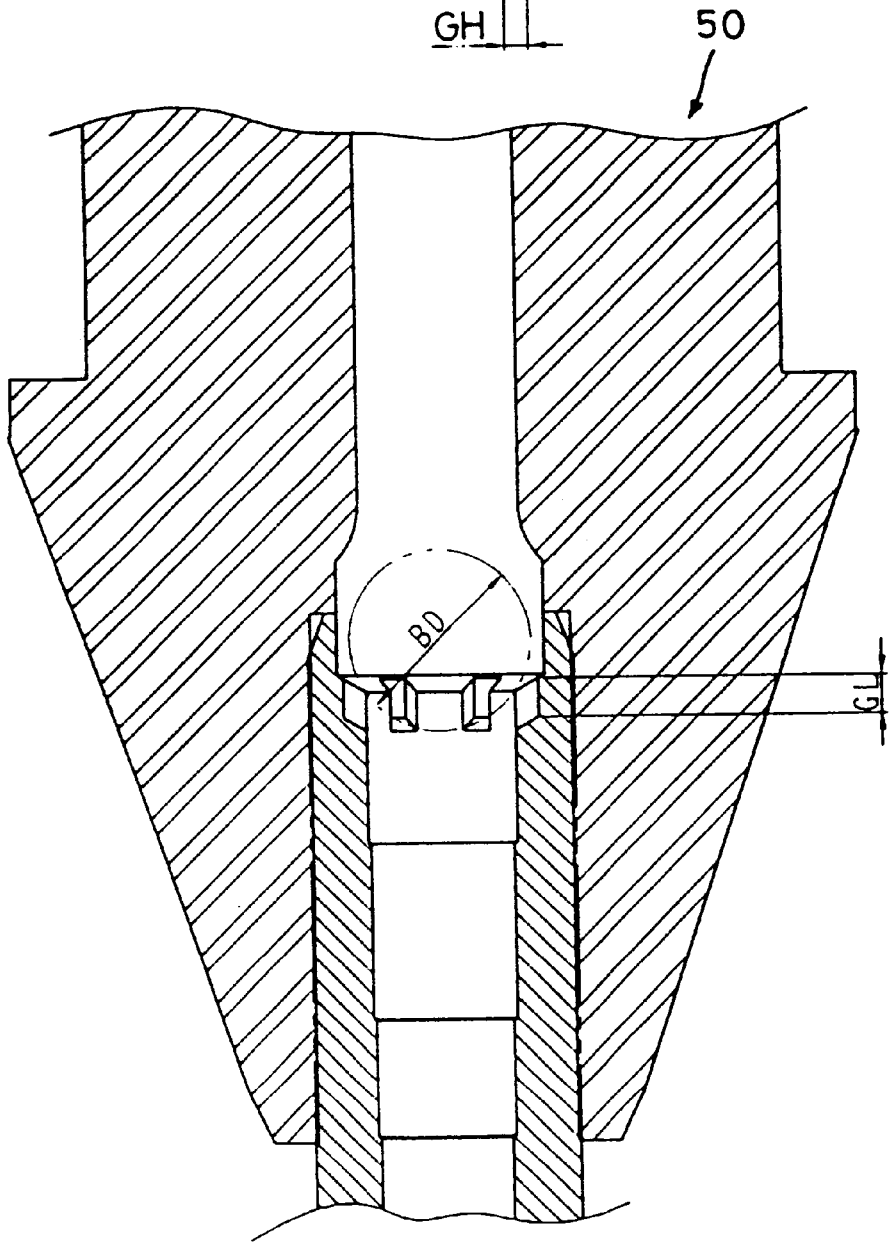

Similarly to FIG. 4, FIG. 15(*b*) is an enlarged cross section taken along the line C—C in FIG. 15(*a*). FIGS. 15(*a*) and 15(*b*) show the penpoint tip and the connector proposed in the present 'yet still further' embodiment, together with ajunction involving them.

The valve support which the ball-point pen 50 in this embodiment comprises has six radially-extending cut grooves (interstices) 51, as seen in FIG. 15(*a*). Each groove is rectangular in cross section.

It also is to be noted here that in a projection of the valve body 8 and the interstices 51 made onto a plane perpendicular to an axis of the pen such interstice regions as not hidden with the valve body 8 have a total area of at least 0.035 $mm^2$.

Further, the cut grooves (interstices) 51 have a total area of at greatest 0.40 $mm^2$.

More in detail, each groove 51 which the ball-point pen 50 in this embodiment has is generally rectangular in a side elevation of the penpoint tip's 5 proximal end. The following equations (1) and (2): namely, $$GW\times(OD-BD)\div 2\times n \geqq 0.035\ mm^2 \quad (1),$$

and $$GW\times GH\times n \leqq 0.40\ mm^2 \quad (2)$$

will apply to parameters: 'GW'=width of each groove, 'GH'=depth of each groove, 'GL'=length of each groove, 'OD'=diameter of a circle circumscribed around all the grooves (interstices), 'BD'=diameter of the valve body, and 'n'=the number of the grooves. The dimension defined with parameter 'GL' does not include any distance which the imperfect portion of each groove extends as shown in FIG. 15(*b*).

These equations (1) and (2) are for an ideal case wherein both the outer and inner vertical walls of each groove are strictly flat and the cross section thereof is ideally rectangular. However, the actual grooves whose walls are arc-shaped as parts of respective peripheries as in the embodiment can be defined herein by said equations without any substantial inaccuracy.

Since the ball-point pen 50 of the present embodiment satisfies both the equations (1) and (2), the ink will flow smoothly through the valve support 15, avoiding the problem of ink-blurring. In addition, the chuck gripping a raw material of the tip will not slip thereon when broaching the grooves (interstices) 51.

The ink to be filled in the pen 50 of this embodiment may be any one of the known inks whose vehicles are water or any hydrophilic solvent such as included in alcohols, glycols or ethers. However, the present invention will be more useful if any of metal-pigment-containing inks (viz., 'metallic' inks), double-color-developing inks, titanium-oxide-containing inks or pearl-glossy-pigment-containing inks, that will be detailed below.

The pigments dispersed in the metal-pigment-containing inks may be aluminum powder, brass powder, copper powder, gold powder, silver powder or the like. Among these, aluminum powder is the best one in assuring the effects which the present invention can afford.

Aluminum powder may either be a 'leafing' type or a 'non-leafing' type. Preferable examples of aluminum powder pigments include: 'ALPASTE' series: WJP-U75C, WE1200, WXM7675 and WXM 0630 (these four types made by the Toyo Aluminum Co., Ltd.), '1110W' and '2172SW' (these two from the Showa aluminum Co., Ltd.), 'AW-808C' and 'AW-7000R' (from the Asahi Chemical Industries Co., Ltd.).

Some colored aluminum pigments such as 'F500-RG', 'F500BG-W' and 'F701RE-G' (all from Showa Aluminum) are also employable.

Examples of brass pigments as the other metal powder pigments 'BS-605', 'BS-607' (from Toyo Aluminum), 'Bronze-Powder P-555', and 'Bronze-Powder P-777' (from the Nakajima Metallic Powders Co., Ltd.).

Any of these metal powder pigments may be used alone, or alternatively two or more of them used in combination.

If average particle size of these metal pigments is much smaller than a proper value, then metallic glossy of written characters or the like will not be satisfiable. If contrarily the average size is much greater than the proper value, then the penpoint will tend to be clogged with the ink that does not flow fluently. The average size within a range of 5 to 30 $\mu$m, or more preferably within a range of 5 to 15 $\mu$m, will give an excellent writing property and a satisfactory printability.

The double-color-developing inks usually contain each a colorant poorly permeable into a surface layer of an ink-applied article in combination with another colorant highly permeable into said layer, and water in combination with a water-soluble organic solvent. The poorly permeable colorant may preferably be a metal powder pigment such as aluminum pigment, a brass pigment or the like. Therefore, this ink may also be classified in the already-mentioned metal-pigment-containing inks. Examples of such pigments are the same as those which have been listed above, and will not be shown here again.

If average particle size of these metal pigments is much smaller than an appropriate standard, then metallic glossy of written characters or the like will be unsatisfactory. If contrarily the actual average size is much greater than the standard, then the penpoint will tend to be clogged with the ink that does not flow fluently. The average size within a range of 1 to 20 $\mu$m will give an excellent writing property as well as a satisfactory printability.

The conventional pigments that have been used in the aqueous inks may also be employed herein as the poorly permeable colorant, in place of the metal pigments. Those conventional pigments are: inorganic pigments such as carbon black and titanium dioxide, quinacridon pigments such as quinacridon violet, and some insoluble azoic pigments such as Hansa Yellow 10G.

The highly permeable pigments may be any of the known and conventional dyestuffs and pigments, provided that they can readily be dissolved or dispersed in a solvent, without suffering from any problem.

The dyestuffs employable herein are for instance metal-complex dyes, acid dyes, direct dyes and basic dyes, as listed below. The acid dyes include: benzene azoic dyes, pyrazolone azoic dyes, acetoacetic-anilide azoic dyes, naphthalene-derivative azoic dyes, deep-color-developing disazo dyes, high-efficient disazo dyes, quinizarin dyes, bromoamine dyes, anthraquinone dyes, nitro dyes and the like. The direct dyes include: copper-phthalocyanine dyes, benzine dyes, tolidine dyes, dianisidine dyes, stilbene diazo dyes, diazo dyes each having a urea bond, azoic dyes each having a coupling group, diamine-diphnylamine azoic dyes, polyazo dyes each having azo groups in series, polyazoic dyes, thiazole azo dyes, sulfonated pigments and the like. The basic dyes include: diphenyl-methane dyes, triphenyl-methane dyes, acridine dyes, di-(tri-)allyl methane dyes, quinoneimine dyes, xanthene dyes, azoic dyes, polymethine dyes, azomethine dyes, diazomethine dyes, diazo-trimethine dyes, triazo-trimethine dyes, triazole-azo dyes, thiazole-azo dyes, benzothiazole-azo dyes, and the like.

The pigments preferable herein are for example phthalocyanine, dioxadine, carbon black and the like. Fluorescent pigments may also be used.

Any of the listed colorants may be used alone, or any two or more may be used in combination.

The water-soluble organic solvents noted above are alcohols, glycols, glycol ethers and the like. Preferable examples of such organic solvents are: dipropyleneglycol monopropylether, dipropyleneglycol monomethyl-ether, hexylene glycol, and the like.

There is no limitation herein as to titanium dioxide in the titanium oxide-containing inks, but those of various types (including the rutile type and the anatase type) that are put on the market may be employed. For example, those whose brand is: 'Kronos' suffixed with KR-270, KR-270D, KR-380, KR-380A, KR-380B, KR-380C, KR-380D and KR-380N (all from the Titan Kogyo Co., Ltd.); a further brand 'Tipaque' suffixed with CR-58, CR-60, CR-602, CR-63, CR-80, CR-90, CR-93 and CR-95 (all from the Ishihara Sangyo Co., Ltd.); or still further products of titanium dioxide numbered FR-22, FR-41, FR-44, FR-66 and FR-77 (all from the Furukawa Machinery Co., Ltd.), are all available.

Titanium oxide (viz., titanium dioxide as noted above) is of a specific gravity of about 4 that is much higher than those of aluminum (about 2.7) and mica (2.7 to 3.1). As a result, the thickener will sometimes fail to completely prevent the pigment deposition. To avoid this problem, a fine powder of a high polymer may be added to the titanium-oxide-containing inks. The powder consisting of flake-shaped flat minute high polymer particles is more effective to stabilize dispersion, and thus more preferable, than that consisting of spherical particles.

The high polymer composed of flat minute particles may be selected from the group consisting of: polyoleffin resins such as polyethylene or polypropylene, styrene-based resins such as polyvinyl chloride, acrylic resins such as polymethacrylates (e.g., methyl ester) or polyacrylates, Nylon (a registerd trademark) and the like resins, fluoroplastics, amine-based resins and the like.

Average diameter of the flat minute particles of those polymer powders must not exceed 10 μm, for the sake of smooth flow of the inks out of each pen. Thus, the average diameter will be selected for example within a range of 0.05 to 10 μm, desirably within a narrower range of 0.1 to 5 μm and more desirably within a much narrower range of 0.2 to 1 μm. Preferable thickness of each flat and minute particle may be about one to two thirds of the average diameter, that is a diametrical size measured in a plane perpendicular to the direction of thickness.

'Multiple 240D' (of an average diameter: 0.5 μm) that is a product of the Mitsui-Toatsu Chemical Co., Ltd. is one preferable example of such polymer powders.

Examples of the pigments to be contained in the pearl-glossy-pigment containing inks are: 'Iriodin' series, 'Timiron MP' series and 'Extender W' (all from the Merck Japan Co., Ltd.). The 'Iriodin' series includes the types: −100, −103, −111, −120, −123, −151, −153, −163, −173, −201, −211, −221, −223, −231, −205, −215, −217, −219, −225, −235, −249, −259, −289 and −299. The 'Timiron' series includes the types: −115, −1001, −47, −1005, −10 and −45SP.

In addition to the pearl-glossy-pigments listed above, any known dyes and/or carbon black may be added to such an ink so as to vary its tone of color.

The so-called 'colored pearl-glossy-pigments' that may be used to dispense with the dyes for this purpose are for example 'Iriodin 300' series, 'Iriodin 500' series, 'Timiron MP-25, ibid.-20, 'Colorona Bronze', 'Colorona Light Blue' and 'Colorona Platina Silver' (all from Merck Japan). 'Iriodin 300' series includes the types: −300, −302, −303, −306, −309, −320, −323, −351 and −355. 'Iriodin 500' series includes the types: −500, −502, −504, −505, −507, −520, −522, −524, −530, −532 and −534. If these pigments are used, any desired tone will be obtained without adding any dyestuff, and nevertheless enhancing light-resistance and water-resistance of the pearl-glossy inks.

If average particle size of these pearl-glossy pigments is much smaller than a proper value, then luster of written characters or the like will be unsatisfactory. If contrarily the average size is much greater than the proper value, then the penpoint will tend to be clogged with the ink that does not flow fluently. The average size within a range of 5 to 60 μm will give the inks excellent writing and printing properties.

Generally, thickeners for raising viscosity are added to the aqueoous inks in order to adjust viscosity thereof. The thickeners adapted for use with the ball-point pen 50 of the present embodiment are thixotropic polysaccharides or derivatives thereof.

In this case, these thickeners will make it easy to prepare thixotropic 'gel type' inks. Due to thixotropicity, the inks' apparent viscosity will be lowered when passing by the writing ball, affording a desirable performance to the ball-point pens each filled with an aqueous ink.

Particularly preferable thickeners are natural polysaccharides and derivatives thereof, such as microbial polysaccharides and their derivatives, water-soluble plant polysaccharides and their derivatives, water-soluble animal polysaccharides and their derivatives.

The microbial polysaccharides and derivatives may be: 'pluran', xanthan gum, welan gum, rhamsan gum, succinoglucan, dextran and the like. The water-soluble plant polysaccharides and derivatives thereof may be: tragacanth gum, guar gum, tara gum, locust bean gum, ghatti gum, arabinogalactan gum, Arabic gum, quince seed gum, pectin, starch, psyllium seed gum, carrageenan, alginic acid, agar and the like. The water-soluble animal polysaccharides and derivatives may be gelatin, casein and the like.

Among these thickeners, the microbial polysaccharides and their derivatives are most suitable for the ink containing aluminum powder pigments and having to be of a longer pot life to improve the writing performance of the applicator.

Rhamsan gum is particularly recommended to achieve the longer pot life (viz., better preservation) of that type of the inks, and the product 'K7C 233' from the Sansho Co., Ltd. is useful for this purpose.

Viscosity of the ink compositions may desirably be regulated to fall within a range of 2000 to 40000 mPa·s at 20° C. in order that aluminum pigment or the like included in the metal powder pigment-containing inks be prevented from depositing or precipitating therein. A good writing performance as well as a satisfactory printing property will be obtained in this manner, and especially the viscosity had better be adjusted to fall within a narrower range of from 3000 to 15000 mPa·s at 20° C.

The data of viscosity given in this Specification are all those which have been or will be measured using a viscometer of the 'ELD' type with a cone rotor (3° cone R14) rotating at 0.5 rpm.

In case of the double-color-developing inks, viscosity thereof may desirably be regulated to fall within a range of 1000 to 10000 mPa·s at 20° C. in order that metal powder pigment or the like included in this type of inks be prevented from depositing or precipitating therein. A good writing performance as well as a satisfactory printing property will be obtained in this manner, and especially the viscosity had better be controlled to be from 2000 to 5000 mPa·s at 20° C.

As for the titanium oxide-containing inks, viscosity thereof may desirably be regulated to fall within a range of 1000 to 12000 mPa·s at 20° C. in order that titanium dioxide pigment or the like included in this type of inks be prevented from depositing or precipitating therein. A good writing performance as well as a satisfactory printing property will also be obtained in this manner, and especially the viscosity had better be controlled to be from 3000 to 9000 mPa·s at 20° C.

Where any of the pearl-glossy pigment-containing inks is employed, viscosity thereof may desirably be regulated to fall within a range of 2000 to 40000 mPa·s at 20° C. in order that aluminum powder pigment or the like included in this type of inks be prevented from depositing or precipitating therein. A good writing performance as well as a satisfactory printing property will be obtained in this manner, and especially the viscosity had better be controlled to be from 3000 to 15000 mPa·s at 20° C.

An appropriate content of the polysaccharide or the like is 0.01 to 4% by weight of the entirety of each ink composition, and more preferably 0.3 to 2% by weight. A poorer content will impair dispersion of the pigment such as a metal powder, likely causing same to precipitate soon. However, a much richer content of said polysaccharide or the like will excessively raise viscosity of the ink, rather rendering same less suited to the writing or printing use.

Any proper stabilizer such as sodium bezoate or the like sodium carboxylate may be added to the ink, if necessary, as a stabilizer for the thickener.

Similar to the prior art inks, any desired dyestuff, a surfactant, a dispersant, an anti-corrosion agent, a pH regulator, an anti-rusting agent and/or a antifoaming agent may be added also to any ink described above.

Although the connector intervenes between the distal end (i.e., penpoint tip) and the ink reservoir in each illustrated embodiment, the present invention is also applicable to an applicator whose ink reservoir is formed integral with a part functioning as such a connector.

Some ball-point pens were prepared by us as Examples and References given below. These ball-point pens differ from each other only in shape of their valve supports formed in the penpoint tips and in dimension of their valve bodies. Accordingly, FIGS. 16(*a*) to 24(*b*) showing those Examples or References are grouped into pairs each consisting of a figure suffixed with (a) and another with (b), and the former (a) is an end elevation (regarded also as a 'side' elevation) as seen from a proximal end of each penpoint tip, with the latter (b) being a cross section taken along the line E—E in the former. The penpoilit tips were manufactured each by machining a raw piece of a free-cutting steel (Hv: 200–280, tensile strength: 600–780 N/mm$^2$) so that the ink-feeding bores are of the same diameter of 1.3 mm. All the interstices were grooves rectangular in cross section. The inks filled in those Examples and References each comprised water as the solvent, aluminum powder as the pigment, and rhamsan gum 'K7C 233' (from the Sansho Co., Ltd.) as the thickener.

EXAMPLE 1

Figure 16A:
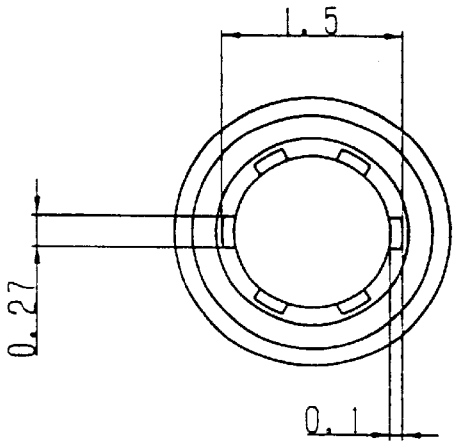
FIG. 16(*a*) is a side elevation of a penpoint tip used in Example 1.
Figure 16B:
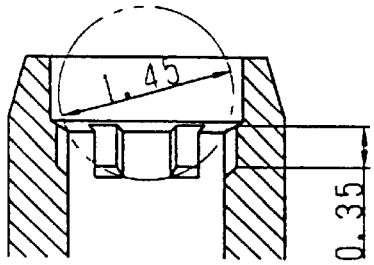

FIG. 16(*a*) is an end elevation of the penpoint tip, and FIG. 16(*b*) is a cross section taken along the line E—E in FIG. 16(*a*).

The ball-point pen in Example 1 had a penpoint tip as shown in FIGS. 16(*a*) and 16(*b*). Formed in its valve support were six (6) cut grooves rectangular in cross section. Each interstice had: a width 'GW' of 0.27 mm, a depth 'GH' of 0.1 mm, an overall diameter 'OD' of 1.5 mm, and a length 'GL' of 0.35 mm. The valve body was a sphere having a diameter of 1.45 mm.

Regarding each of the interstices as substantially being rectangular in a projection of them, areas of those interstices not hidden with the valve body in a projection were calculated to be approximately:

0.27 mm×(1.5 mm−1.45 mm )÷2×6=0.0405 mm$^2$ in total.

EXAMPLE 2

Figure 17A:
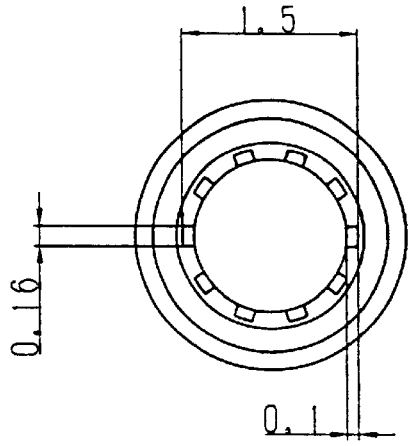
FIG. 17(*a*) is a side elevation of a penpoint tip used in Example 2.
Figure 17B:
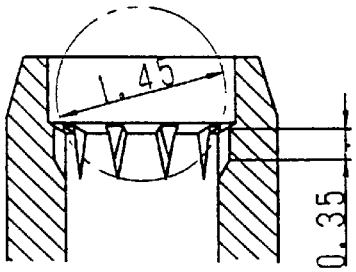

FIG. 17(*a*) is an end elevation of the penpoint tip, and FIG. 17(*b*) is a cross section taken along the line E—E in FIG. 17(*a*).

The ball-point pen in Example 2 had a penpoint tip as shown in FIGS. 17(*a*) and 17(*b*). Formed in its valve support were ten (10) cut grooves each rectangular in cross section and each having inner region gradually reducing its width.

Each interstice in the ball-point pen of this Example 2 had: a width 'GW' of 0.16 mm, a depth 'GH' of 0.1 mm, an overall diameter 'OD' of 1.5 mm, and a length 'GL' of 0.35 mm. The valve body was a sphere having a diameter of 1.45 mm.

Regarding each of the interstices as substantially being rectangular in a projection of them, areas of those interstices not hidden with the valve body in a projection were calculated to be approximately:

0.16 mm×(1.5 mm−1.45 mm)÷2×10=0.04 mm$^2$ in total.

EXAMPLE 3

FIG. 18(*a*) is an end elevation of the penpoint tip, and FIG. 18(*b*) is a cross section taken along the line E—E in FIG. 18(*a*).

The ball-point pen in Example 3 had a penpoint tip as shown in FIGS. 18(*a*) and 18(*b*). Formed in its valve support were six (6) cut grooves each rectangular in cross section. Each interstice in the ball-point pen of this Example 3 had: a width 'GW' of 0.30 mm, a depth 'GH' of 0.2 mm, an overall diameter 'OD' of 1.7 mm, and a length 'GL' of 0.35 mm. The valve body was a sphere having a diameter of 1.45 mm.

Areas of those interstices not hidden with the valve body in a projection were calculated to be approximately:

0.30 mm×(1.7 mm−1.45 mm)÷2×6=0.225 mm$^2$ in total.

In this embodiment and in the following Example 4, a gross area inclusive of the hidden and non-hidden regions of the grooves cut as the interstices was of the largest value among the Examples, and calculated to be:

0.30 mm×(1.7 mm−1.3 mm)÷2×6=0.36 mm$^2$in total.

EXAMPLE 4

FIG. 19(*a*) is an end elevation of the penpoint tip, and FIG. 19(*b*) is a cross section taken along the line E—E in FIG. 19(*a*).

The ball-point pen in Example 4 had a penpoint tip as shown in FIGS. 19(*a*) and 19(*b*). Formed in its valve support were six (6) cut grooves each rectangular in cross section. Each interstice in the ball-point pen of this Example 4 had: a width 'GW' of 0.30 mm, a depth 'GH' of 0.2 mm, an overall diameter 'OD' of 1.7 mm, and a length 'GL' of 0.35 mm. The valve body was a sphere having a diameter of 1.59 mm.

Areas of those interstices not hidden with the valve body in a projection were calculated to be approximately:

0.30 mm×(1.7 mm−1.59 mm)÷2×6=0.099 mm$^2$ in total.

REFERENCE 1

FIG. 20(*a*) is an end elevation of the penpoint tip, and FIG. 20(*b*) is a cross section taken along the line E—E in FIG. 20(*a*).

The ball-point pen in Reference 1 had a penpoint tip as shown in FIGS. 20(*a*) and 20(*b*). Formed in its valve support were eight (8) cut grooves each rectangular in cross section and each having inner region gradually reducing its width. Each interstice in the ball-point pen of this Reference 1 had: a width 'GW' of 0.14 mm, a depth 'GH' of 0.1 mm, an overall diameter 'OD' of 1.5 mm, and a length 'GL' of 0.35 mm. The valve body was a sphere having a diameter of 1.45 mm.

Areas of those interstices not hidden with the valve body in a projection were calculated to be approximately:

0.30 mm×(1.5 mm−1.45 mm)÷2×8=0.028 mm$^2$ in total.

REFERENCE 2

FIG. 21(*a*) is an end elevation of the penpoint tip, and FIG. 21(*b*) is a cross section taken along the line E—E in FIG. 21(*a*).

The ball-point pen in Reference 2 had a penpoint tip as shown in FIGS. 21(*a*) and 21(*b*). Formed in its valve support were eight (8) cut grooves each rectangular in cross section. Each interstice in the ball-point pen of this Reference 2 had: a width 'GW' of 0.14 mm, a depth 'GH' of 0.1 mm, an overall diameter 'OD' of 1.5 mm, and a length 'GL' of 0.35 mm. The valve body was a sphere having a diameter of 1.59 mm.

The valve body's diameter (1.59 mm) was greater than the overall diameter (1.5 mm) of a circle circumscribed around the interstices, thus giving an area of '0 mm$^2$' in a projection for regions not hidden with the valve body.

This area of '0 $mm^2$' for the unbidden regions does however not mean that those interstices were completely closed with the valve body. As seen in FIG. 21(*b*), the interstices closed in the projection were still effective to allow the ink reservoir to communicate with the penpoint tip.

REFERENCE 3

FIG. 22(*a*) is an end elevation of the penpoint tip, and FIG. 22(*b*) is a cross section taken along the line E—E in FIG. 22(*a*).

The ball-point pen in Reference 3 had a penpoint tip as shown in FIGS. 22(*a*) and 22(*b*). Formed in its valve support were six (6) cut grooves each rectangular in cross section. Each interstice in the ball-point pen of this Reference 3 had: a width 'GW' of 0.27 mm, a depth 'GH' of 0.1 mm, an overall diameter 'OD' of 1.5 mm, and a length 'GL' of 0.35 mm. The valve body was a sphere having a diameter of 1.59 mm.

Also, the valve body's diameter (1.59 mm) was greater than the overall diameter (1.5 mm) of a circle circumscribed around the interstices, thus giving an area of '0 $mm^2$' in a projection for regions not hidden with the valve body.

REFERENCE 4

FIG. 23(*a*) is an end elevation of the penpoint tip, and FIG. 23(*b*) is a cross section taken along the line E—E in FIG. 23(*a*).

The ball-point pen in Reference 4 had a penpoint tip as shown in FIGS. 23(*a*) and 23(*b*). Formed in its valve support were ten (10) cut grooves each rectangular in cross section and each having inner region gradually reducing its width. Each interstice in the ball-point pen of this Reference 4 had: a width 'GW' of 0.16 mm, a depth 'GH' of 0.1 mm and an overall diameter 'OD' of 1.5 mm. The valve body was a sphere having a diameter of 1.59 mm.

Those interstices were entirely and completely hidden with the valve body in a projection. This was because the latter's diameter (1.59 mm) was greater than the overall diameter (1.5 mm) of a circle circumscribed around the interstices, thus giving an area of '0 $mm^2$' for the unhidden regions.

REFERENCE 5

Figure 24A:
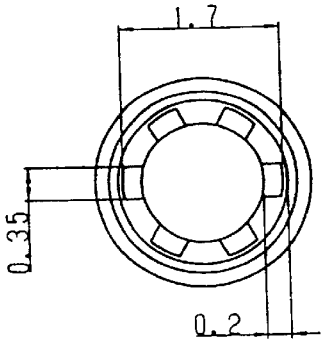
FIG. 24(*a*) is a side elevation of a penpoint tip used in Reference 5.
Figure 24B:
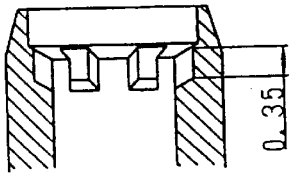
Figure 25A:
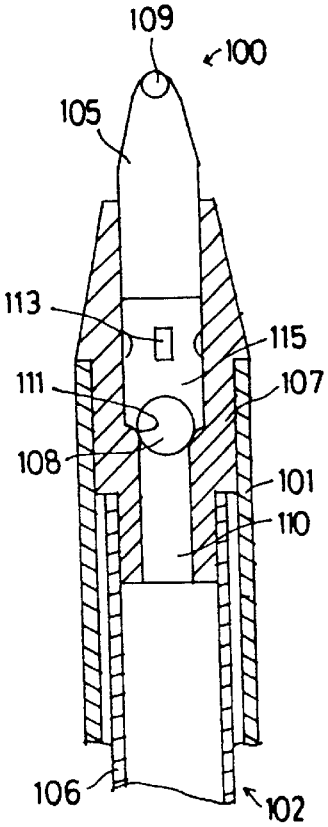
FIG. 25A (PRIOR ART)
FIG. 25(*a*) is a cross section of the prior art ball-point pen disclosed in the Japanese Utility Model Publication No. Hei.4-52067.
Figure 25B:
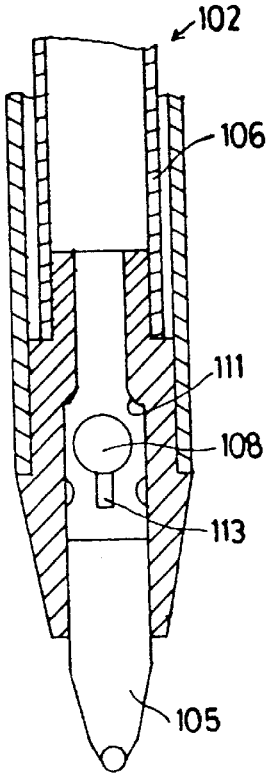
FIG. 25B (PRIOR ART)

FIG. 24(*a*) is an end elevation of the penpoint tip, and FIG. 24(*b*) is a cross section taken along the line E—E in FIG. 24(*a*).

It was intended in the ball-point pen to form in its valve support six (6) cut grooves as the interstices each rectangular in cross section and as shown in FIGS. 24(*a*) and 24(*b*) each having a width of 0.35 mm, a depth of 0.2 mm (encircled with a circle having a diameter of 1.7 mm) and a length of 0.35 mm. However, due to the loosening of a chuck machining a raw material in this way, such a penpoint tip could not be manufactured.

In this Reference, a gross area inclusive of the hidden and non-hidden regions of the grooves cut as the interstices was calculated to be:

$0.35\ mm \times (1.7\ mm - 1.3\ mm) \div 2 \times 6 = 0.42\ mm^2$ in total.

COMPARISON OF EXAMPLES WITH REFERENCES

In Examples 1 to 3 and Reference 1, a valve body of a diameter of 1.45 mm was employed. In Example 4 and References 2 to 4, another valve body of a diameter of 1.59 mm was employed. In each of couples: References 1 and 2; Example 1 and Reference 3; Example 2 and Reference 4; and Examples 3 and 4, only the diameter of the valve bodies differs, with the interstices being of the same shape and dimension.

Writing tests were carried out using the ball-point pens prepared in the respective Examples and References. As a result, the pens of the Examples 1 to 4 have proved smooth even in a mode of high speed writing, whereas the other pens of References 1 to 4 produced blurred characters to such a degree that the high speed writing would be rendered difficult and almost impossible.

Comparison of Example 1 with Reference 3, as well as comparison of Example 2 and Reference 4, have revealed the fact that not only the shape and size of interstices but also the size of valve bodies do affect the ink streams. Larger valve bodies cooperating with the interstices of the same shape and size decrease the areas of said interstices' regions not hidden by said bodies in a projection. It may be considered that this reduction in the unhidden projected areas in the projection would possibly force the ink streams having advanced along each valve body's surface to subsequently deviate from the interstices, thus becoming reluctant to move towards the tip end.

From another comparison of Example 1 to 3 with Reference 1, it may be concluded that even if the interstices were not wholly hidden by the valve body in a projection, a somewhat decreased area of each unhidden region would also render it difficult for the ink streams to further advance towards the tip end. Reference 1 (giving a total area of 0.028 $mm^2$ to the projected images of interstices) caused the blurring in high speed-written characters, almost disabling the writing. In contrast with such a Reference 1, Example 2 (giving said projected area of 0.040 $mm^2$) ensured a smooth high speed-writing. A numerical critical point or threshold might thus be supposed to exist at about 0.035 $mm^2$ of the projected area unbidden by the valve body.

Comparison of Examples 3 and 4 with Reference 5 will make it clear that an upper limit resides at about 0.40 $mm^2$ for a gross area formable by machining the material.

Further, ten additional types of penpoint tips were prepared whose end-elevational shape is the same as that in Example 1 (see FIG. 16(*a*) referred to above) but having interstices of a length different from that in Example 1. A spherical valve body of a diameter of 1.45 mm was combined with each penpoint tip to provide ten additional types of the ball-point pens. They were then subjected to a continuous writing test to compare flow rate of the ink between them. It was thus confirmed that the ink flow rate did noticeably change as the interstice length 'GL' was made not equal to the interstice width 'GW'. So long as the length 'GL' had been set greater than the width 'GW', the ink flow rate remained almost constant. Therefore, the length of grooves serving as the interstices has to be designed greater than their width. Taking into account easiness in machening those grooves, it may be most preferable that their length is substantially the same as their width.

UTILIZE ABILITY IN THE INDUSTRIES

The present invention provides an applicator such as a ball-point pen that affords a smooth writing without fear of the blurring of an ink, even if the ink is such as an aqueous metallic ink that has a relatively high viscosity in spite of its aqueous composition.

What is claimed is:

1. An applicator comprising a penpoint tip having a distal end in which a writing ball is secured and having an ink-feeding bore extending through and axially of the penpoint tip and a proximal end, an ink reservoir for holding therein an amount of an ink, a connector for connecting the penpoint tip to the reservoir, a communicating bore formed through the connectorso as to communicate with both the ink reservoir and the penpoint tip, and a valve seat formed in the communicating bore such that a valve body moving axially of the penpoint tip is allowed to rest on and engage with the valve seat, wherein the penpoint tip has an increased-inner-diameter region that is formed in and adjacent to an opening of the ink-feeding bore and located in the connector so that the valve body is capable of transferring partially or wholly into the ink-feeding bore, there being a single piece that defines the increased-inner-diameter region and at least a majority of an axial dimension of the ink-feeding bore in the penpoint tip, and the ink-feeding bore has an engagement portion defined by the single piece adjacent the proximal end of the penpoint tip that is capable of engaging with and stopping the valve body in such a manner that an interstice for passage of the ink is provided between the engagement portion and the valve body, whereby with the penpoint tip facing upwards, the valve body is allowed to tightly rest on the valve seat so as to prevent the ink from flowing backward, whilst the valve body is capable of moving at least partially into the ink-feeding bore and engaging with the engagement portion so as to allow the ink to flow through the interstice towards the writing ball if the penpoint tip is held in position facing downwards.

2. An applicator as defined in claim 1, wherein the penpoint tip is received in the connector's communicating bore, and a region thereof intervening between the valve seat and the penpoint tip's proximal end has an inner diameter substantially equal to that of said penpoint tip's increased diameter region.

3. An applicator as defined in claim 1, wherein the valve body is a sphere.

4. An applicator as defined in claim 1, wherein the engagement portion for the valve body is formed as annnular stepping zone disposed at a boundary between the increased-diameter region and remaining regions of the ink-feeding bore, and grooves are engraved in the stepping zone so as to serve as the interstice through which the ink flows.

5. An applicator as defined in claim 4, wherein the grooves are each triangular, arc-shaped or tetragonal in cross section, and a plurality of the grooves are formed in the stepping zone.

6. An applicator as defined in claim 1, wherein the valve body is made of a non-magnetizable material.

7. An applicator as defined in claim 6, wherein the non-magnetizable material forming the valve body is an austenitic stainless steel.

8. An applicator as defined in claim 7, wherein a material forming the penpoint tip is selected from the group consisting of ferrite-based stainless steels and martensitic stainless steels.

9. An applicator as defined in claim 6, wherein a material forming the penpoint tip is selected from the group consisting of ferrite-based stainless steels and martensitic stainless steels.

10. An applicator as defined in claim 6, wherein viscosity of the ink is 100 mPa·s or higher at a shear rate of 10 $sec^{-1}$ or less.

11. The applicator as defined in claim 1 wherein the penpoint tip has a groove extending partially radially through the penpoint tip with a radially facing surface extending in an axial direction within the groove so that ink is guided axially along the radially facing surface within the groove.

12. An ink backflow-preventing mechanism in an applicator comprising:

a main body having an ink reservoir filled with ink, a penpoint tip made of a metal and secured to the main body, an ink-feeding bore formed through the penpoint tip, a valve chamber having a valve seat and communicating with both the ink reservoir and the ink-feeding bore through the penpoint tip, and a valve body having a diameter and disposed in the valve chamber so as to come into contact with the valve seat to thereby prevent the ink from flowing backwards, wherein the valve body is made of a non-magnetizable material, the penpoint tip comprises a single piece that defines an annular opening for the valve body and a valve support against which the valve body abuts with the valve body in the annular opening, wherein at least 40% of the diameter of the valve body resides in the annular opening with the valve body abutted to the valve support.

13. An applicator comprising: an ink reservoir, an ink-dispensing penpoint tip having a stepped diameter opening at an upstream end defining a valve support at the upstream end and a valve mechanism, wherein the valve mechanism comprises a valve body movable in directions in which an ink flows, a valve seat disposed upstream of the valve body and adjacent to the ink reservoir, the valve support disposed downstream of the valve body and adjacent to the penpoint tip and, wherein the valve support is capable of coming into engagement with the valve body such that at least one interstice is provided between them for passage of the ink, and the valve body is capable of resting on the valve seat so as to inhibit the ink from flowing backwards if and while the tip of said applicator stands facing upwards, whereas the valve body is caused to rest on the valve support to permit the ink to flow through the at least one interstice and towards the tip if and while the tip faces downwards, wherein the valve body's portion contacting the valve support is spherical in shape, and in a projection of the valve body and the at least one interstice made onto a plane perpendicular to the direction in which the ink flows in a region of the at least one interstice as not hidden with the valve body has a total area of at least 0.035 $mm^2$, there being a surface on the penpoint tip that extends continuously and uninterruptedly through 360° around the valve body with the valve body resting on the valve support.

14. An applicator as defined in claim 13, wherein the at least one interstice is formed as a cut groove and the cut groove has in a direction in which the ink flows a length greater than the width of the cut groove.

15. An applicator as defined in claim 13, wherein the valve body is a sphere.

16. An applicator as defined in claim 13, wherein viscosity of the ink is 3000 to 15000 mPa·s at 20° C.

17. An applicator as defined in claim 16, wherein the ink is an aqueous ink containing a pigment whose average particle diameter is from 5 $\mu$m to 30 $\mu$m.

18. An applicator as defined in claim 16, wherein the ink contains a thickener for raising viscosity of the ink.

19. An applicator as defined in claim 18, wherein the thickener is a thixotropic polysaccharide or its derivative.

20. An applicator as defined in claim 19, wherein the thixotropic polysaccharide is a microbial polysaccharide.

21. An applicator as defined in claim 13, wherein the ink is an aqueous ink containing a pigment whose average particle diameter is from 5 $\mu$m to 30 $\mu$m.

22. An applicator as defined in claim 13, wherein the ink consists of a metal powder-containing ink, a double color-developing ink, a titanium oxide-containing ink and/or a pearl-glossy pigment-containing ink.

23. An applicator comprising: a penpoint tip having a distal end in which a writing ball is secured and having an ink-feeding bore extending through and along an axis of the penpoint tip, the applicator further comprising: an ink reservoir for holding therein an amount of an ink, a connector for connecting the penpoint tip to the reservoir, a communicating bore formed through the connector so as to communicate with both the ink reservoir and the penpoint tip, and a valve seat formed in the communicating bore such that a valve body moving axially of the pen is allowed to rest on and engage with the valve seat, wherein the penpoint tip has an increased-inner-diameter region that is formed in and adjacent to an opening of the ink-feeding bore and located in the connector so that the valve body is capable of transferring at least partially into the ink-feeding bore, and the ink-feeding bore has an engagement portion capable of engaging with and temporarily stopping the valve body in such a manner that at least one interstice for passage of the ink is provided between the engagement portion and the valve body, the penpoint tip comprising a single piece defining the distal end in which the writing ball is secured, the increased-inner-diameter region, and the engagement portion, whereby with the penpoint tip facing upwards, the valve body tightly rests on the valve seat so as to prevent the ink from flowing backward, whilst the valve body moves into the ink-feeding bore and engages with the engagement portion so as to allow the ink to flow through the at least one interstice towards the writing ball if the penpoint tip is held in position facing downwards, wherein with a projection of the valve body and the at least one interstice made onto a plane perpendicular to the axis of the penpoint tip, a region of the at least one interstice as not hidden with the valve body has a total area of at least 0.035 $mm^2$.

24. An applicator as defined in claim 23, wherein the penpoint tip is made of a metal, the at least one interstice is formed as a cut groove.

25. An applicator as defined in claim 24, wherein the at least one interstice is formed as a cut groove and the cut groove has in a direction in which the ink flows a length greater than width of the cut groove.

26. A penpoint tip adapted for use with a spherical valve body and a connector, the penpoint tip having a distal end in which a writing ball is secured and having an ink-feeding bore extending through and along an axis of the penpoint tip, wherein the penpoint tip further comprises an increased-inner-diameter region that is formed in and adjacent to an opening of the ink-feeding bore and located in the connector so that the valve body is capable of transferring into the ink-feeding bore, wherein the ink-feeding bore has an engagement portion capable of engaging with and temporarily stopping the valve body in such a manner that at least one interstice is provided between the engagement portion and the valve body extending partially radially through the penpoint tip so as to define a radially facing surface on the penpoint tip within the at least one interstice that guides ink in an axial direction.

27. An applicator comprising a penpoint tip having a distal end in which a writing ball is secured and having an ink-feeding bore extending through and axially of the penpoint tip, an ink reservoir for holding therein an amount of an ink, a connector for connecting the penpoint tip to the reservoir, a communicating bore formed through the connector so as to communicate with both the ink reservoir and the penpoint tip, and a valve seat formed in the communicating bore such that a valve body having a diameter and moving axially of the penpoint tip is allowed to rest on and engage with the valve seat, wherein the penpoint tip has an increased-inner-diameter region that is formed in and adjacent to an opening of the ink-feeding bore and located in the connector so that at least 40% of the diameter of the valve body is capable of transferring into the ink-feeding bore, and the ink-feeding bore has an engagement portion capable of engaging with and stopping the valve body in such a manner that an interstice for passage of the ink is provided between the engagement portion and the valve body, whereby with the penpoint tip facing upwards, the valve body is allowed to tightly rest on the valve seat so as to prevent the ink from flowing backward, whilst the valve body is capable of moving into the ink-feeding bore and engaging with the engagement portion so as to allow the ink to flow through the interstice towards the writing ball if the penpoint tip is held in position facing downwards.

28. The applicator as defined in claim 27 wherein there is a single piece that defines the increased-inner-diameter region, the engagement portion, and at least a majority of an axial dimension of the ink-feeding bore in the penpoint tip.

29. The applicator as defined in claim 27 wherein the penpoint tip has a groove extending partially radially through the penpoint tip with a radially facing surface extending in an axial direction within the groove so that ink is guided axially along the radially facing surface within the groove.

* * * * *